US006917343B2

(12) United States Patent
Sanchez et al.

(10) Patent No.: US 6,917,343 B2
(45) Date of Patent: Jul. 12, 2005

(54) BROADBAND ANTENNAS OVER ELECTRONICALLY RECONFIGURABLE ARTIFICIAL MAGNETIC CONDUCTOR SURFACES

(75) Inventors: Victor C. Sanchez, Laurel, MD (US); William E. McKinzie, III, Fulton, MD (US); Rodolfo E. Diaz, Phoenix, AZ (US)

(73) Assignee: Titan Aerospace Electronics Division, Greenbelt, MD (US)

( * ) Notice: Subject to any disclaimer, the term of this patent is extended or adjusted under 35 U.S.C. 154(b) by 0 days.

(21) Appl. No.: 10/246,198

(22) Filed: Sep. 17, 2002

(65) Prior Publication Data

US 2003/0112186 A1 Jun. 19, 2003

Related U.S. Application Data

(60) Provisional application No. 60/323,587, filed on Sep. 19, 2001.

(51) Int. Cl.[7] ..... H01Q 1/38
(52) U.S. Cl. ..... 343/795; 343/909
(58) Field of Search ..... 343/753, 754, 343/756, 795, 792.5, 895, 909

(56) References Cited

U.S. PATENT DOCUMENTS

| | | | | |
|---|---|---|---|---|
| 4,367,474 A | | 1/1983 | Schaubert et al. | 343/700 |
| 4,751,513 A | | 6/1988 | Daryoush et al. | 343/700 |
| 5,511,238 A | | 4/1996 | Bayraktaroglu | 455/81 |
| 6,175,337 B1 | | 1/2001 | Jasper, Jr. et al. | 343/770 |
| 6,292,143 B1 | | 9/2001 | Romanofsky | 343/700 |
| 6,483,480 B1 | * | 11/2002 | Sievenpiper et al. | 343/909 |
| 6,525,695 B2 | | 2/2003 | McKinzie | 343/756 |
| 6,538,621 B1 | * | 3/2003 | Sievenpiper et al. | 343/909 |
| 2002/0167457 A1 | | 11/2002 | McKinzie, III et al. | 343/909 |
| 2003/0011518 A1 | | 1/2003 | Sievenpiper et al. | 343/700 |

FOREIGN PATENT DOCUMENTS

| | | | |
|---|---|---|---|
| WO | WO 99/50929 | 10/1999 | H01Q/1/38 |
| WO | WO 01/24313 A1 | 4/2001 | H01Q/3/46 |
| WO | WO 01/67552 A1 | 9/2001 | H01Q/15/24 |
| WO | WO 01/73891 A1 | 10/2001 | H01Q/15/00 |
| WO | WO 01/73892 A2 | 10/2001 | H01Q/15/00 |
| WO | WO 01/73893 A1 | 10/2001 | H01Q/15/00 |

OTHER PUBLICATIONS

R. J. King and K.S. Park, "Synthesis of surface reactance using grounded pin bed structure," *Electronics Letters*, vol. 17, 1981, pp. 52–53.

S. M. Sze, "Physics of Semiconductor Devices—Chapter 2.7.4 Varactor", published by Wiley & Sons, 1981, pp 114–122.

Ray. J. King, David. V. Theil, and Kwang S. Park, "The synthesis of surface reactances using an artificial dielectric," *IEEE Trans. Antennas and Propagation*, vol. AP–31, No. 3, May 1983, pp. 471–476.

R. M. Walser et. al., "New smart materials for adaptive microwave signature control," *Proceedings of the Society of Photo–Optical Instrumentation Engineers* (*SPIE*), vol. 1916, 1993, pp. 128–134.

(Continued)

*Primary Examiner*—Michael C. Wimer
(74) *Attorney, Agent, or Firm*—Brinks Hofer Gilson & Lione

(57) ABSTRACT

A low profile antenna system includes an artificial magnetic conductor comprising a frequency selective surface (FSS) having an effective sheet capacitance which is electronically variable to control resonant frequency of the AMC and the resonant frequency of an antenna element positioned adjacent to the FSS.

33 Claims, 16 Drawing Sheets

OTHER PUBLICATIONS

John C. Vardaxoglou, "*Frequency Selective Surfaces: Analysis and Design*," Research Studies Press Ltd, Copyright 1997, pp 1–9, 18–73, 116–152 and 221–273.

Daniel F. Sievenpiper, "High–impedance electromagnetic surfaces," Ph.D. dissertation, UCLA electrical engineering department, filed Jan. 1999, 161 pages.

D. Sievenpiper, L. Zhang, and E. Yablonovitch, "High–impedance electromagnetic ground planes," *IEEE Intl. MTT–S Symp.*, Jun. 13–19, 1999, Anaheim, CA. 4 pages.

D. Sievenpiper, R. Broas, and E. Yablonovitch, "Antennas on high–impedance ground planes," *IEEE Intl. MTT–S Symp.*, Jun. 13–19, 1999, Anaheim, CA, 4 pages.

L. Zhang, N. G. Alexopoulos, D. Sievenpiper, and E. Yablonovitch, "An efficient finite–element method for the analysis of photonic bandgap materials," *IEEE Intl. MTT–S Symp.*, Jun. 13–19, 1999, Anaheim, CA, 4 pages.

Dan Sievenpiper, Lijun Zhang, Romulo F. Jimenez Broas, Nicolaos G. Alexopoulos, and Eli Yablonovitch, "High–impedance electromagnetic surfaces with a forbidden frequency band," *IEEE Trans. Microwave Theory and Techniques*, vol. 47, No. 11, Nov. 1999, pp. 2059–2074.

Ruey Bing Hwang and Song Tsuen Peng, "Guidance Characteristics of Two–Dimensionally Periodic Impedance Surface", *IEEE Trans. Microwave Theory and Techniques*, vol. 47, No. 12, Dec. 1999, pp. 2503–2511.

Rudolfo E. Diaz, James T. Aberle, and William E. McKinzie III, "TM mode analysis of a Sievenpiper high–impedance reactive surface," *IEEE Intl. Antennas and Propagation Symp.* Jul. 16–21, 2000, Salt Lake City, Utah, 24 pages.

M. Rahman and M., A. Stuchly, "Equivalent circuit model of 2D microwave photonic bandgap structures," *URSI National Radio Science Meeting*, Jul. 16–21, 2000, Salt Lake City, Utah, pp. 322.

G. Poilasne and E. Yablonovitch, "Matching antennas over high–impedance ground planes," *URSI National Radio Science Meeting*, Jul. 16–21, 2000, Salt Lake City, Utah, pp. 312.

R. B. Hwang, S. T. Peng and C. C. Chen, "Surface–Wave Suppression of Resonance–Type Periodic Structures", IEEE MTT–S Digest, Copyright 2000, pp. 1525–1528.

Ben A. Munk, "*Frequency Selective Surfaces, Theory and Design*," John Wiley and Sons, New York, Copyright 2000, pp 26–62 and 279–314.

R. J. King and S. W. Cho, "Surface Impedance Planes", Dept. of Electrical and Computer Engineering, University of Wisconsin, Copyright 2000, 16 pages.

Golla, Keven J. "Broadband Application of High Impedance Ground Planes," Mar., 2001, 105 pages.

D. Sievenpiper, H.–P. Hsu, J. Schaffner, G. Tangonan, R. Garcia and S. Ontiveros, "Low–Profile, four–sector diversity antenna on high–impedance ground plane," Electronics Letters, Aug. 3, 2000, vol. 36, No. 16, 2 pages.

Keisuke Kageyama et al., "Tunable Active Filters Having Multilayer Structure Using LTCC", IEEE, Copyright 2001, 4 pages.

D. Sievenpiper, J. Schaffner, B. Loo, G. Tangonan, R. Harold, J. Pikkulski, R. Garcia, "Electronic Beam Steering Using a Varactor–Impedance Surface," 2001 IEE Antennas and Propagation Soc'y Int'l Symposium, Boston, Mass., Jul. 8–13, 2001, vol. 1, pp. 174–177.

International Search Report for international application No. PCT/US02/13542, dated Jul. 11, 2002, 6 pages.

International Preliminary Examination Report for international application No. PCT/US02/13542, dated Apr. 11, 2003, 4 pages.

* cited by examiner

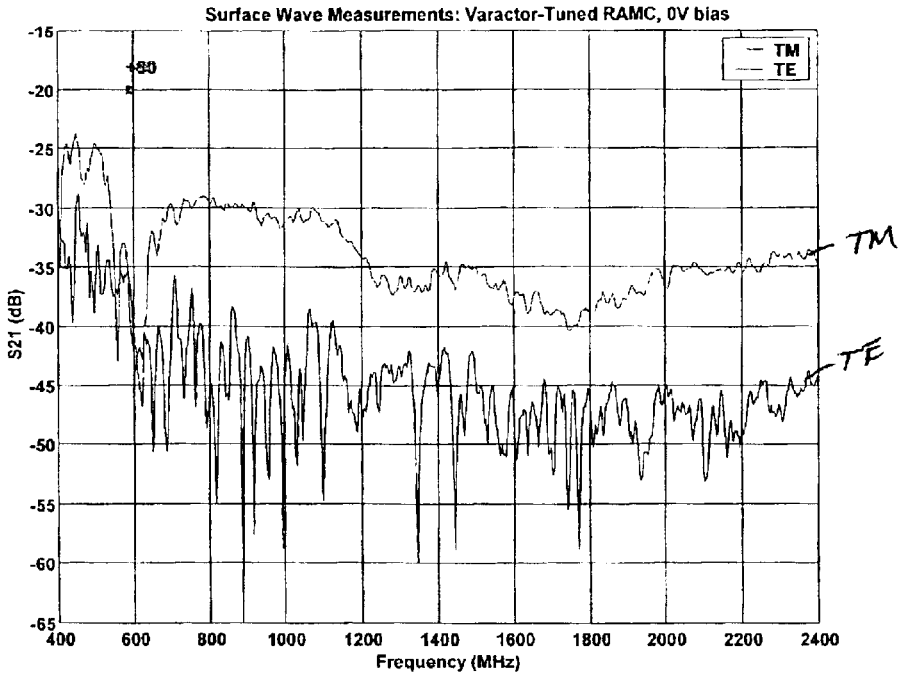
FIG. 10
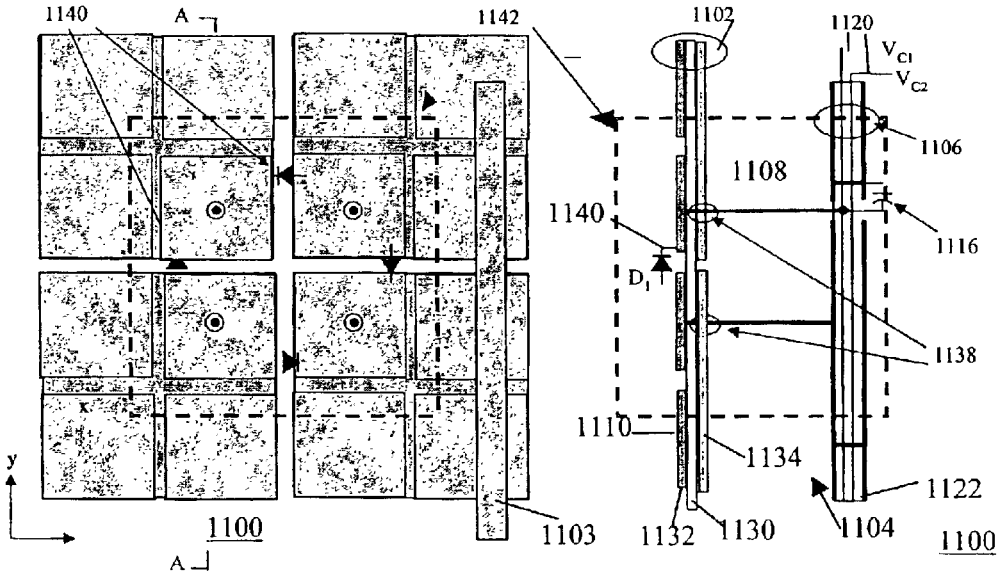
FIG. 11
FIG. 12

1300

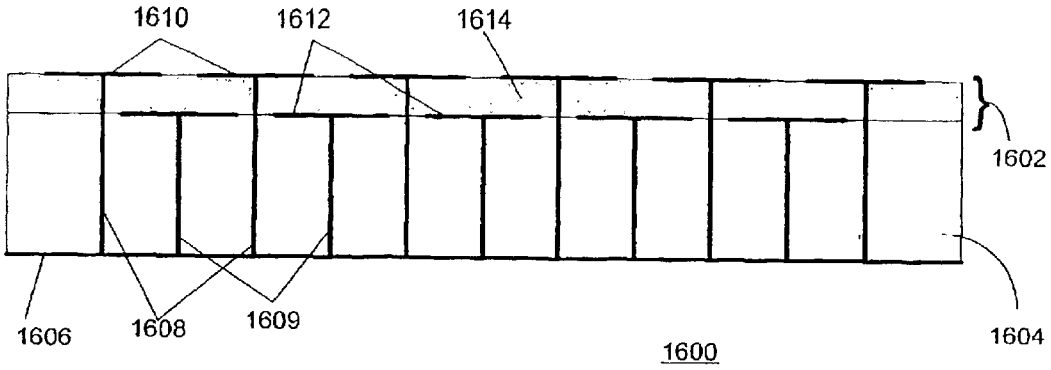
FIG. 16 - Prior art -
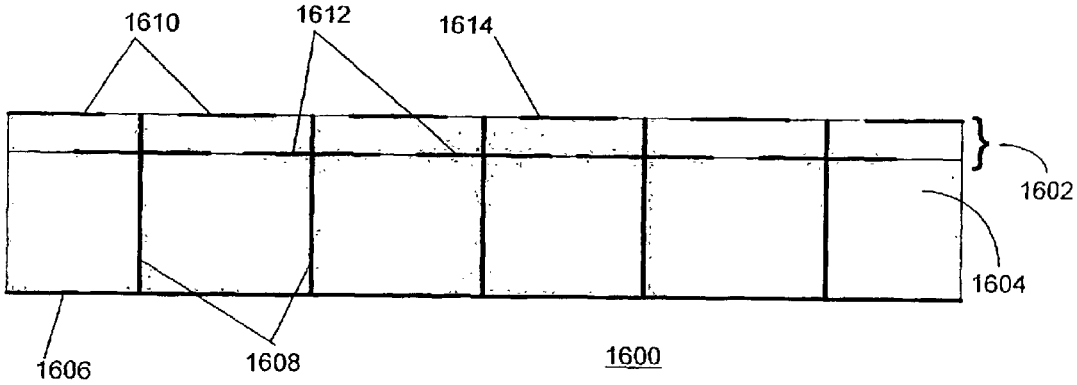
FIG. 17
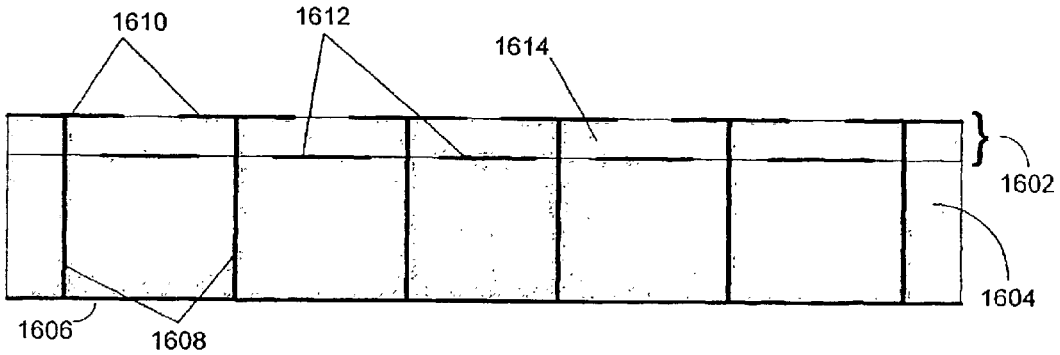
FIG. 18 1600

-Prior Art -

BROADBAND ANTENNAS OVER ELECTRONICALLY RECONFIGURABLE ARTIFICIAL MAGNETIC CONDUCTOR SURFACES

RELATED APPLICATIONS

This application claims priority of U.S. provisional patent application No. 60/323,587, filed Sep. 19, 2001 in the names of Victor C. Sanchez, et al, incorporated herein by reference. This application is related to U.S. application Ser. No. 09/845,666, filed Apr. 30, 2001 in the names of William E. McKinzie III, et al. and entitled RECONFIGURABLE ARTIFICIAL MAGNETIC CONDUCTOR, and U.S. Ser. No. 09/845,393, filed Apr. 30, 2001 in the name of William E. McKinzie III entitled RECONFIGURABLE ARTIFICIAL MAGNETIC CONDUCTOR USING VOLTAGE CONTROLLED CAPACITORS WITH COPLANAR RESISTIVE BIASING NETWORKS, which applications are incorporated herein by reference in their entirety.

FEDERALLY SPONSORED RESEARCH

This invention was developed in part under DARPA Contract Number F19628-99-C-0080.

BACKGROUND

The present invention relates to the development of reconfigurable artificial magnetic conductor (RAMC) surfaces for low profile antennas. This device operates as a high-impedance surface over a tunable frequency range, and is electrically thin relative to the frequency of interest, λ.

A high impedance surface is a lossless, reactive surface, realized as a printed circuit board, whose equivalent surface impedance is an open circuit, which inhibits the flow of equivalent tangential electric surface currents, thereby approximating a zero tangential magnetic field. A high-impedance surface is important because it offers a boundary condition which permits wire antennas (electric currents) to be well matched and to radiate efficiently when the wires are placed in very close proximity to this surface (<λ/100 away). The opposite is true if the same wire antenna is placed very close to a metal or perfect electric conductor (PEC) surface. It will not radiate efficiently. The radiation pattern from the antenna on a high-impedance surface is confined to the upper half space above the high impedance surface. The performance is unaffected even if the high-impedance surface is placed on top of another metal surface. The promise of an electrically-thin, efficient antenna is very appealing for countless wireless device and skin-embedded antenna applications.

One embodiment of a thin, high-impedance surface 100 is shown in FIG. 1. It is a printed circuit structure forming an electrically thin, planar, periodic structure, having vertical and horizontal conductors, which can be fabricated using low cost printed circuit technologies. The high-impedance surface or artificial magnetic conductor (AMC) 100 includes a lower permittivity spacer layer 104 and a capacitive frequency selective surface (FSS) 102 formed on a metal backplane 106. Metal vias 108 extend through the spacer layer 104, and connect the metal backplane to the metal patches 110 of the FSS layer. The thickness of the high impedance surface 100 is much less than λ/4 at resonance, and typically on the order of λ/50, as is indicated in FIG. 1.

The FSS 102 of the prior art high impedance surface 100 is a periodic array of metal patches 110 which are edge coupled to form an effective sheet capacitance. This is referred to as a capacitive frequency selective surface (FSS). Each metal patch 110 defines a unit cell which extends through the thickness of the high impedance surface 100. Each patch 110 is connected to the metal backplane 106, which forms a ground plane, by means of a metal via 108, which can be plated through holes. The spacer layer 104 through which the vias 108 pass is a relatively low permittivity dielectric typical of many printed circuit board substrates. The spacer layer 104 is the region occupied by the vias 108 and the low permittivity dielectric. The spacer layer is typically 10 to 100 times thicker than the FSS layer 102. Also, the dimensions of a unit cell in the prior art high-impedance surface are much smaller than λ at the fundamental resonance. The period is typically between λ/40 and λ/12.

Another embodiment of a thin, high-impedance surface is disclosed in U.S. patent application Ser. No. 09/678,128, entitled "Multi-Resonant, High-Impedance Electromagnetic Surfaces," filed on Oct. 4, 2000, commonly assigned with the present application and incorporated herein by reference. In that embodiment, an artificial magnetic conductor is resonant at multiple resonance frequencies. That embodiment has properties of an artificial magnetic conductor over a limited frequency band or bands, whereby, near its resonant frequency, the reflection amplitude is near unity and the reflection phase at the surface lies between +/−90 degrees. At the resonant frequency of the AMC, the reflection phase is exactly zero degrees. That embodiment also offers suppression of transverse electric (TE) and transverse magnetic (TM) mode surface waves over a band of frequencies near where it operates as a high impedance surface.

Another implementation of a high-impedance surface, or an artificial magnetic conductor (AMC), which has nearly an octave of +/−90° reflection phase, was developed under DARPA Contract Number F19628-99-C-0080. The size of this exemplary AMC is 10 in. by 16 in by 1.26 in thick (25.4 cm×40.64 cm×3.20 cm). The weight of the AMC is 3 lbs., 2 oz. The 1.20 inch (3.05 cm) thick, low permittivity spacer layer is realized using foam. The FSS has a period of 298 mils (0.757 cm), and a sheet capacitance of 0.53 pF/sq. The FSS substrate had a thickness of 0.060 inches, and was made using Rogers R04003 material. The FSS was fabricated using two layers of metallization, where the overlapping patches were essentially square in shape.

The measured reflection coefficient phase of this broadband AMC, referenced to the top surface of the structure is shown in FIG. 2 as a function of frequency. A ±90° phase bandwidth of 900 MHz to 1550 MHz is observed. Three curves are traced on the graph, each representing a different density of vias within the spacer layer. For curve AMC1–2, one out of every two possible vias is installed, and only the upper patches are connected to the vias. For curve AMC1–4, one out of every four vias is installed. In this case, only half of the upper patches are connected to vias, and the patches connected form a checkerboard pattern. For curve AMC1–18, one out of every 18 vias is installed. In this third case, only one in every 9 of the upper patches has an associated via. As expected from the effective media model described in application Ser. No. 09/678,128, the density of vias does not have a strong effect on the reflection coefficient phase.

Transmission test set-ups are used to experimentally verify the existence of a surface wave bandgap for this broadband AMC. In each case, the transmission response ($S_{21}$) is measured between two Vivaldi-notch radiators that are mounted so as to excite the dominant electric field polarization for transverse electric (TE) and transverse magnetic (TM) modes on the AMC surface. For the TE set-up, the antennas are oriented horizontally. For the TM set-up, the antennas are oriented vertically. Absorber is placed around the surface-under-test to minimize the space wave coupling between the antennas. This optimal configuration—defined empirically as "that which gives the smoothest, least-noisy response and cleanest surface wave cutoff"—is obtained by trial and error. The optimal configuration is obtained by varying the location of the antennas, the placement of the absorber, the height of absorber above the surface-under-test, the thickness of absorber, and by placing a conducting foil "wall" between layers of absorber to mitigate free space coupling between test antennas. The measured $S_{21}$ for both configurations is shown in FIG. 3. As can be seen, a sharp TM mode cutoff occurs near 950 MHz, and a gradual TE mode onset occurs near 1550 MHz. The difference between these two cutoff frequencies is referred to as a surface wave bandgap. This measured bandgap is correlated closely to the +/−90-degree reflection phase bandwidth of the AMC illustrated in FIG. 2.

The resonant frequency of the prior art AMC, shown in FIG. 1, is given by Sievenpiper et. al. (*IEEE Trans. Microwave Theory and Techniques,* Vol. 47, No. 11, Nov. 1999, pp. 2059–2074), (also see "High Impedance Electromagnetic Surfaces," dissertation of Daniel F. Sievenpiper, University of California at Los Angeles, 1999) as $f_0=1/(2\pi\sqrt{LC})$ where C is the equivalent sheet capacitance of the FSS layer in Farads per square, and $L=\mu_0 h$ is the permeance of the spacer layer, with h denoting the height or thickness of this layer.

In most wireless communications applications, it is desirable to make the antenna ground plane as small and light weight as possible so that it may be readily integrated into physically small, light weight platforms such as radiotelephones, personal digital assistants and other mobile or portable wireless devices. The relationship between the instantaneous bandwidth, BW, of an AMC with a non-magnetic spacer layer and its thickness is given by $$\frac{BW}{f_0} = 2\pi\frac{h}{\lambda_0}$$

where $\lambda_0$ is the free space wavelength at resonance where a zero degree reflection phase is observed. Thus, to support a wide instantaneous bandwidth, the AMC thickness must be relatively large. For example, to accommodate an octave frequency range ($BW/f_0=0.667$), the AMC thickness must be at least 0.106 $\lambda_0$, corresponding to a physical thickness of 1.4 inches at a center frequency of 900 MHz. This thickness is too large for many practical applications.

Accordingly, there is a need for an AMC which allows for a larger reflection phase bandwidth for a given AMC thickness. The approach taught in accordance with embodiments of the present invention is to permit the limited reflection phase bandwidth to be electronically reconfigurable.

One popular type of broadband antenna is a cavity backed spiral. This is a slot or wire planar spiral antenna installed over a metal cavity. If the cavity is filled with absorber, then the antenna "sees" only free space above it and the antenna's impedance bandwidth can extend over multiple octaves. The down side is that the antenna's efficiency has an upper bound of only 50% since power radiated into the absorber is wasted as heat. Alternatively, the cavity may be filled with a low loss dielectric material such that the electrical depth of the cavity is one-quarter of a wavelength at the center frequency. Foam or honeycomb are common dielectrics for this purpose, but this forces the antenna to be too thick and heavy for many low frequency applications. Dielectric loading of the cavity will decrease the thickness in proportion to the square root of the dielectric constant, but this forces surface waves or longitudinal section electric (LSE) and longitudinal section magnetic (LSM) modes to be excited in the cavity which create undesired parasitic resonances. Thus, there is a need is create a thin, lightweight substrate, which will not support surface waves, to permit the realization of a shallow cavity, broadband antenna.

BRIEF SUMMARY

The present invention provides a means to electronically adjust or tune the resonant frequency, $f_0$, of a broadband antenna placed in close proximity to an artificial magnetic conductor (AMC) by electronically controlling the resonance frequency of the AMC structure. There are various methods which can be employed to electronically reconfigure the AMC.

By way of introduction only, one present embodiment provides an artificial magnetic conductor (AMC) which includes a frequency selective surface (FSS) having an effective sheet capacitance which is variable to control the resonant frequency of the AMC.

Another embodiment provides an AMC which includes a frequency selective surface (FSS), a conductive backplane structure, and a spacer layer separating the conductive backplane structure and the FSS. The spacer layer includes conductive vias extending between the conductive backplane structure and the FSS. The AMC further includes voltage variable capacitive circuit elements coupled with the FSS and responsive to one or more bias signal lines routed through the conductive backplane structure and the conductive vias.

Another embodiment provides an AMC which includes a frequency selective surface (FSS) including a periodic array of conductive patches, a spacer layer including vias extending therethrough in association with predetermined conductive patches of the FSS, and a conducting backplane structure including two or more bias signal lines. The FSS is characterized by a unit cell which includes, in a first plane, a pattern of three or more conductive patches, one conductive patch of which is electrically coupled with an associated conductive via, and voltage variable capacitive elements between laterally adjacent conductive patches. In a second plane, the FSS is characterized by a conductive backplane segment extending in a plane substantially parallel to a plane including the three or more conductive patches and the associated conductive via extending from the one conductive patch to one of the two or more bias signal lines.

Another embodiment provides an AMC which includes a frequency selective surface (FSS) including a periodic array of conductive patches, a spacer layer including vias extending therethrough in association with predetermined conductive patches of the FSS, and a conducting backplane structure including two or more bias signal lines. The FSS is characterized by a unit cell which includes, in a first plane, a pattern of three or more conductive patches disposed on a first side of a dielectric layer, each conductive patch being electrically coupled with an associated conductive via, and voltage variable capacitive elements between laterally adjacent conductive patches. Each conductive patch overlaps at least in part a spaced conductive patch of a plurality of spaced conductive patches disposed on a second side of the dielectric layer. In a second plane, a conductive backplane segment extends in a plane substantially parallel to a plane including the three or more conductive patches and the associated conductive vias extending from the each conductive patch to one of the two or more bias signal lines.

Another embodiment provides a method for reconfiguring an AMC including a frequency selective surface (FSS) having a pattern of conductive patches, a conductive backplane structure and a spacer layer separating the FSS and the conductive backplane structure. The method comprises applying control bias signals to voltage variable capacitive elements associated with the FSS; and thereby, reconfiguring the effective sheet capacitance of the FSS.

Another embodiment provides a method to create a tunable antenna system whereby a spiral or other planar antenna element is located in close proximity to a reconfigurable AMC such that high antenna efficiency is realized in a frequency band essentially commensurate with the surface wave bandgap of the AMC.

The foregoing summary has been provided only by way of introduction. Nothing in this section should be taken as a limitation on the following claims, which define the scope of the invention.

BRIEF DESCRIPTION OF SEVERAL VIEWS OF THE DRAWINGS

FIG. 10 is a plot of measured TE and TM mode surface wave transmission for a physical embodiment of the reconfigurable artificial magnetic conductor of FIG. 6 with a bias voltage of 0 V;

FIG. 11 is a top view of a third embodiment of a reconfigurable artificial magnetic conductor;

FIG. 12 is a cross sectional view taken along line A—A in FIG. 11;

FIG. 16 is a cross sectional view of a prior art artificial magnetic conductor;

FIG. 17 is a cross sectional view of a first embodiment of an artificial magnetic conductor with a reduced number of vias in the spacer layer; and FIG. 18 is a cross sectional view of a second embodiment of an artificial magnetic conductor with a reduced number of vias in the spacer layer;

DETAILED DESCRIPTION OF THE PRESENTLY PREFERRED EMBODIMENTS

Figure 1:
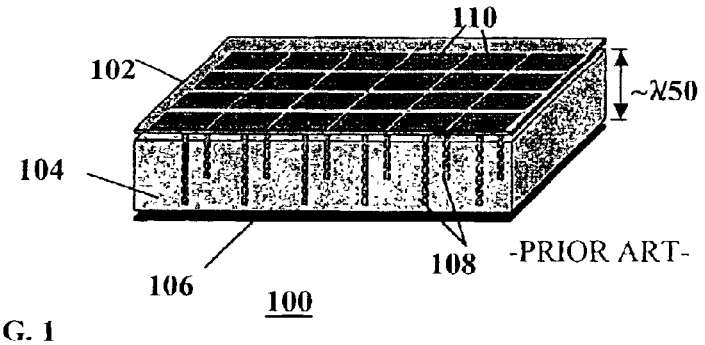
FIG. 1 is a perspective view of a prior art high impedance surface.
Figure 2:
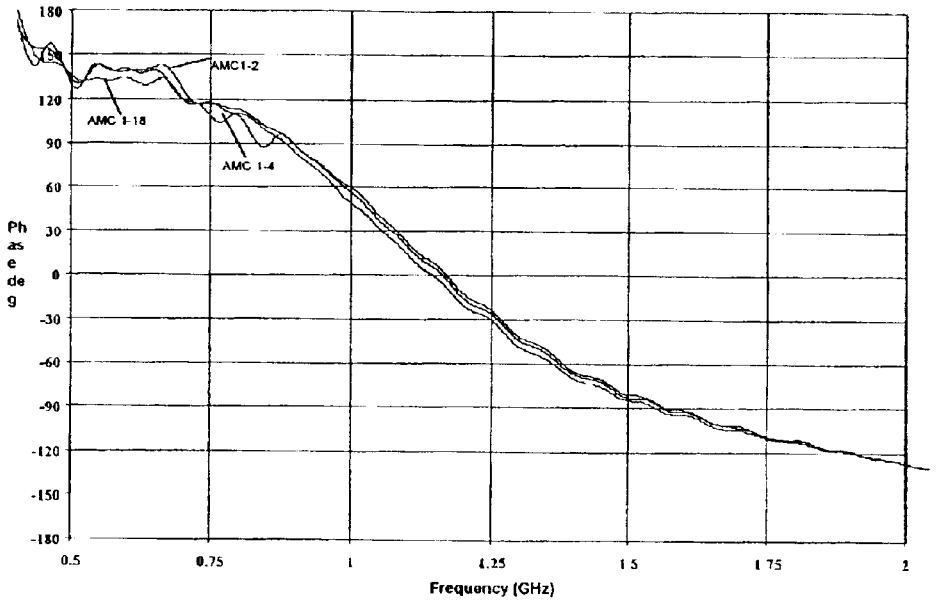
FIG. 2 illustrates measured reflection coefficient phase of a non-reconfigurable high-impedance surface.
Figure 3:
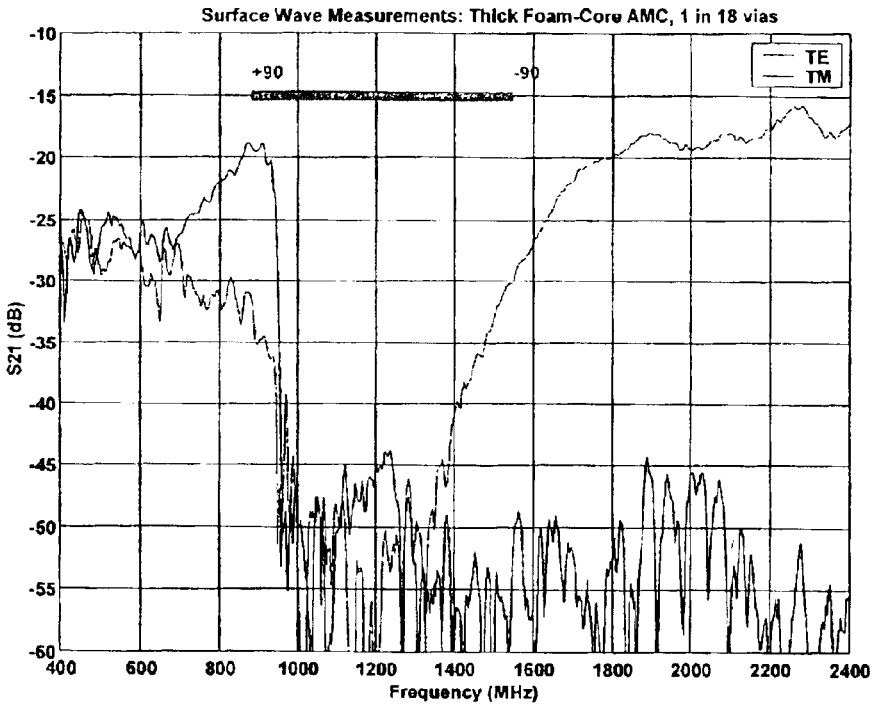
FIG. 3 illustrates TE and TM mode surface wave transmission response for a high-impedance surface.
Figure 4:
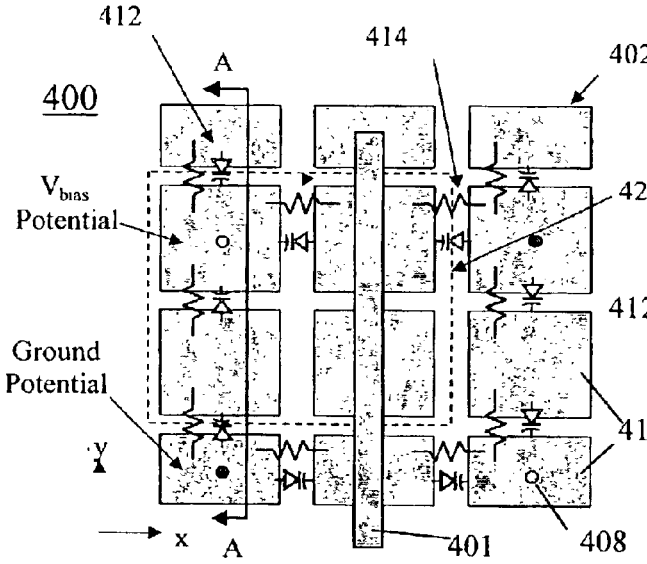
FIG. 4 is a top view of one embodiment of a reconfigurable artificial magnetic conductor.
Figure 5:
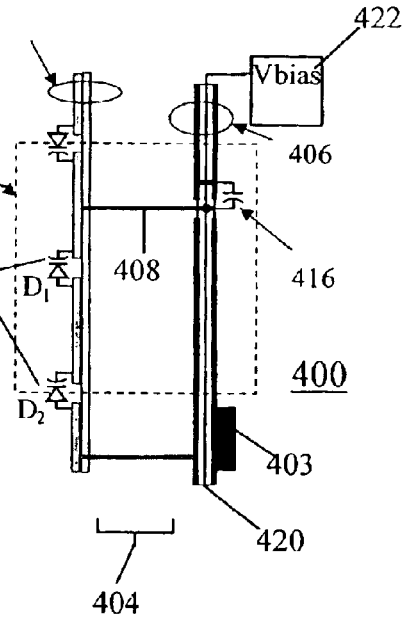
FIG. 5 is a cross sectional view taken along line A—A in FIG. 4.

FIG. 4 is a top view of one embodiment of a reconfigurable artificial magnetic conductor (RAMC) 400. FIG. 5 is a cross sectional view of the RAMC 400 taken along line A—A in FIG. 4. The RAMC 400, like other artificial magnetic conductors, forms a high impedance surface having particular applicability, for example, in conjunction with antennas and other electromagnetic devices.

The RAMC 400 has a frequency selective surface (FSS) 402, which has a variable effective sheet capacitance to control resonant frequency of the RAMC. The capacitance of the FSS 402 is variable under control of a control circuit which operates in conjunction with the RAMC 400. For example, the RAMC 400 may be integrated with a radio transceiver, which controls tuning, reception and transmission of radio signals through an antenna formed in part by the RAMC 400. As part of the tuning process, which selects a frequency for reception or transmission, the control circuit applies appropriate signals to control the capacitance of the FSS 402 to control the resonant frequency of the RAMC 400.

The RAMC 400 further includes a spacer layer 404, a radio frequency (RF) backplane 406 and metal vias 408. The FSS 402 includes a pattern of conductive patches 410. In preferred embodiments, the FSS 402 includes a periodic array of patches 410. In the illustrated embodiment, the conductive patches 410 are made of a metal or metal alloy. In other embodiments, other conductive materials may be used. Further, in the illustrated embodiment, the conductive patches 410 are arranged in a regular pattern and the patches themselves are substantially square in shape. In alternative embodiments, other patch shapes, such as circular, diamond, hexagonal or triagonal, and other patch patterns may be used. Furthermore, all the patches need not be identical in shape. For instance, the patches to which vias 408 are connected may be larger in surface area, while the patches without vias may be reduced in size, without changing the period of the RAMC 400. Still further, a pattern of conductive patches includes patches on a single layer as well as patches disposed in two or more layers and separated by particular materials.

Particular geometrical configurations may be chosen to optimize performance factors such as resonance frequency or frequencies, size, weight, and so on. In one embodiment, the FSS 402 is manufactured using a conventional printed circuit board process to print the patches 410 on one or both surfaces of the FSS and to produce plated through holes to form the vias. Other manufacturing technology may be substituted.

The vias selectively excite patches 410 of the FSS 402 with a bias voltage applied through the RF backplane 406. The vias 408 are used to route DC bias currents and voltage from stripline control lines 420 buried inside the RF backplane. The RF backplane 406 includes one or more ground planes and one or more conductive striplines 420 or a stripline circuit with one or more bias control signals routed in between ground planes of the stripline circuit. The conductive striplines 420 may be biased using one or more external voltage sources such as voltage source 422. In the illustrated embodiment, the voltage source 422 applies a bias voltage $V_{bias}$ between a bias stripline and a ground plane at the surface of the RF backplane 406. Selected vias 408 are electrically coupled with the bias stripline and first alternating patches so that the first alternating patches are a potential $V_{bias}$. Similarly, other selected vias 408 are electrically coupled with the ground plane or a grounded stripline of the RF backplane 406 and with second alternating patches so that the second alternating patches are at ground potential. In this manner, the bias voltage $V_{bias}$ is applied between the alternating patches. Thus, the bias voltages are applied to the FSS 402 through the RF backplane 406 using the stripline or other conductors of the backplane 406 and the vias 408. In alternative embodiments, other bias voltages including time varying biasing signals may be applied in this manner through the RF backplane 406. Using time varying bias control signals, it is possible to modulate the reflection phase of the RAMC, and to convey information to a remote transponder via the phase of the monostatic or bistatic radar cross section presented by the RAMC. No RF transmit power is required at the RAMC. The process of reflecting a modulated signal for communication purposes is known as passive telemetry.

Further, the RAMC 400 includes variable capacitive elements 412, ballast resistors 414 and bypass capacitors 416. In the illustrated embodiment of FIG. 4, the variable capacitive elements are embodied as varactor diodes. A varactor or varactor diode is a semiconductor device whose capacitive reactance can be varied in a controlled manner by application of a bias voltage. Such devices are well known and may be chosen to have particular performance features. The varactor diodes 412 are positioned between and connected to adjacent patches of the FSS 402. The varactor diodes 412 add a voltage variable capacitance in parallel with the intrinsic capacitance of the FSS 402, determined primarily by edge-to-edge coupling between adjacent patches. The bias voltage for the varactor diodes 412 may be applied using the bias voltage source 422. More than one bias voltage may be applied and routed in the RAMC 400 using striplines 420 of the backplane 406 and vias 408. The magnitude of the bias signals may be chosen depending on the materials and geometries used in the RAMC 400. Thus, the local capacitance of the FSS 402 may be varied to control the overall resonant frequency of the RAMC 400. In an alternative embodiment, the conductive backplane structure comprises a stripline circuit and distributed or lumped RF bypass capacitors inherent in the design of the stripline circuit.

The RF bypass capacitors 416 are coupled between stripline conductors of the backplane 406 and a ground plane of the backplane 406. Any suitable capacitor may be used but such a capacitor is preferably chosen to minimize size and weight of the RAMC 400. In appropriate configurations, the bypass capacitors may be soldered directly to the printed circuit board forming the RF backplane 406 or they may be integrated into the structure of the RF backplane 406. Such integrated bypass capacitors may be realized by using low impedance striplines, where the capacitance per unit length is enhanced by employing wider striplines and higher dielectric constant materials. The bypass capacitors 416 are required to decouple RF current at the base of the biasing vias.

The ballast resistors 414 are electrically coupled between adjacent patches 410. The ballast resistors generally have a large value (typically 1 MΩ) and ensure an equal voltage drop across each series diode in the strings of diodes that are found between the biasing vias and the grounded vias.

An antenna whose resonant frequency is reconfigurable may be realized by placing a monopole or dipole 410 parallel to the RAMC surface and in close proximity to the surface. For instance, a monopole could be spaced $\lambda_0/200$ from the RAMC where $\lambda_0$ is the free space wavelength at resonance.

The basic pattern illustrated in FIGS. 4 and 5 may be repeated any number of times in the x and y directions (defined by the coordinate axes shown in FIG. 4). FIGS. 4 and 5 illustrate an RF unit cell 426. The RAMC 400 is characterized by a unit cell 426, which includes, in a first plane including the surface of the FSS 402, a pattern of three or more conductive patches and voltage variable capacitive elements between laterally adjacent conductive patches. One conductive patch of the unit cell is electrically coupled with an associated conductive via 408. In a second plane, the unit cell 426 includes a conductive backplane segment extending substantially parallel to a plane including the three or more conductive patches. The unit cell further includes the associated conductive via extending from the one conductive patch to one of the bias signal lines or grounded vias extending from the RF backplane 406.

Figure 6:
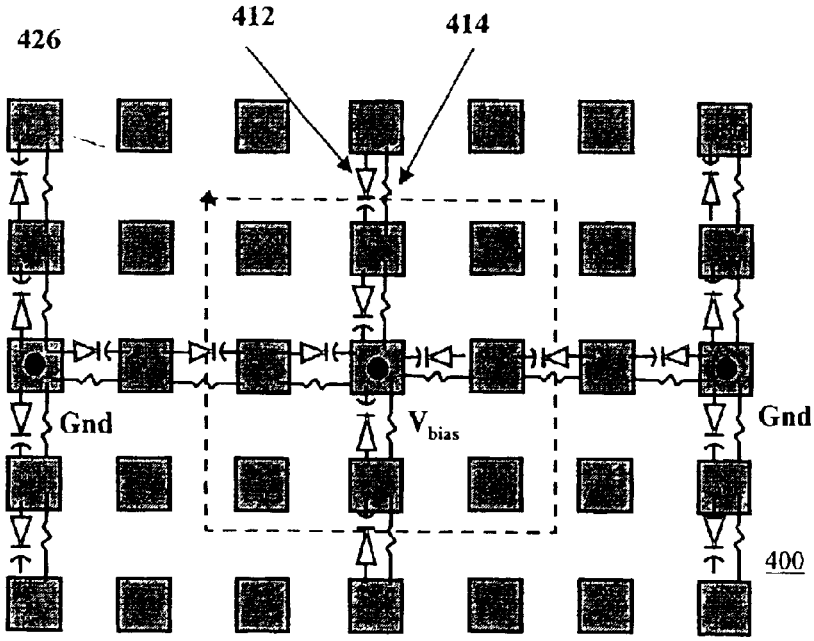
FIG. 6 is a top view of a second embodiment of a reconfigurable artificial magnetic conductor.

FIG. 6 is a top view of a second embodiment of a reconfigurable artificial magnetic conductor 400. In the second embodiment, the varactor diodes 412 are installed in a thinned pattern so as to reduce the capacitance per unit area, as well as the cost, weight and complexity of the RAMC 400. In the exemplary embodiment of FIG. 6, every second and third row and column are not used for integration of the varactor diodes 412. The result is a pattern of strings of diodes 412 and ballast resistors 414 arranged across the surface of the RAMC 400. Alternative embodiments may be designed skipping one, three or N rows of patches between diode strings. Although FIG. 6 implies that patches are uniform in size and shape, this need not be the case. For instance, patches associated with vias may be substantially larger in surface area than patches not associated with vias.

A physical implementation of this embodiment has been fabricated. The best mode of this RAMC is fabricated by sandwiching a 250 mil thick foam core 404 ($\epsilon_r$=1.07) between two printed circuit boards. Alternatively, honeycomb may also be used for the dielectric spacer layer 404. The upper board is single-sided 60 mil Rogers R04003 board and forms the FSS. Plated through holes are located in the center of one out of every nine square patches, 300 mils on a side with a period of 360 mils. Tuning diodes are M/A-COM GaAs MA46H202 diodes, and the ballast resistors are each 2.2 MΩ chips. The RAMC is assembled by installing 22 AWG wire vias between the FSS board and the RF backplane on 1080 mil centers. The RF backplane is a 3 layer FR4 board, 62 mils thick, which contains an internal stripline bias network. Ceramic decoupling capacitors are used on the bottom side of the RF backplane, one at every biasing via. The total thickness of this fabricated RAMC is approximately 0.375 inches excluding the surface mounted components.

Figure 7:
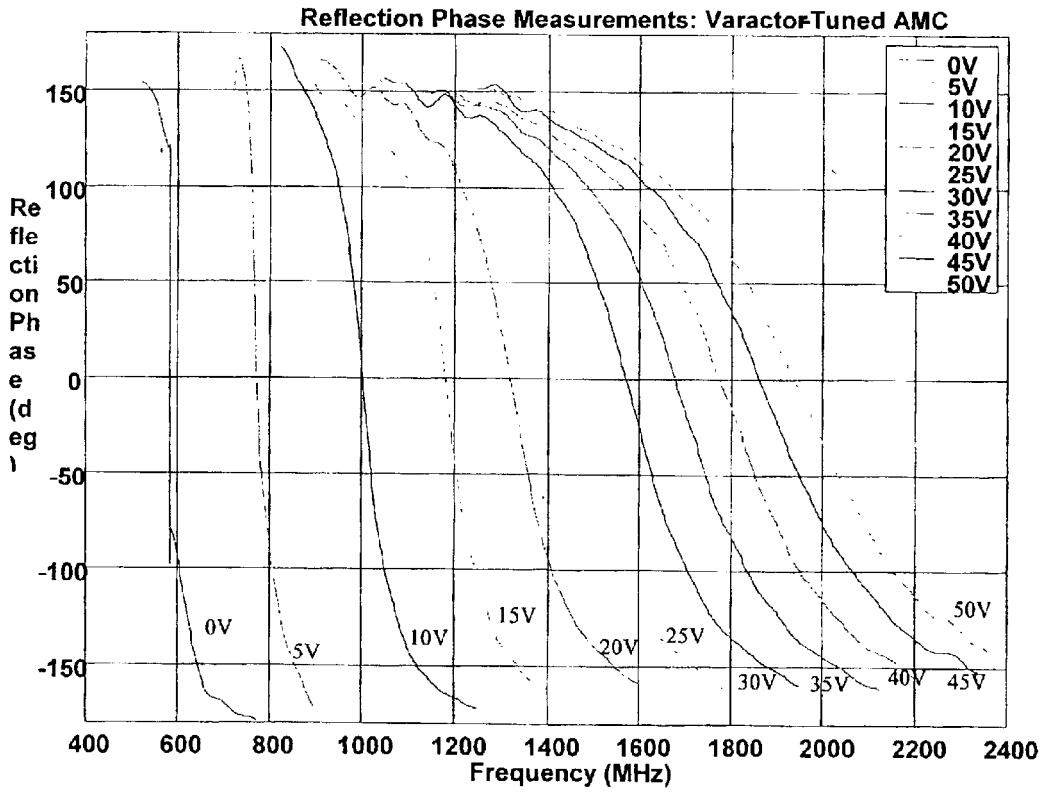
FIG. 7 illustrates reflection phase measurements for a reconfigurable artificial magnetic conductor in accordance with one embodiment of the present invention.

The measured reflection coefficient phase angle versus frequency is shown in FIG. 7 with the varactor bias voltage as a parameter. At each bias level, the instantaneous +/−90-degree bandwidth of the device is relatively narrow. However, as the bias voltage changes, the instantaneous +/−90-degree bandwidth continuously moves across a much wider frequency band, from 600 MHz to 1920 MHz in resonant frequency.

Figure 8:
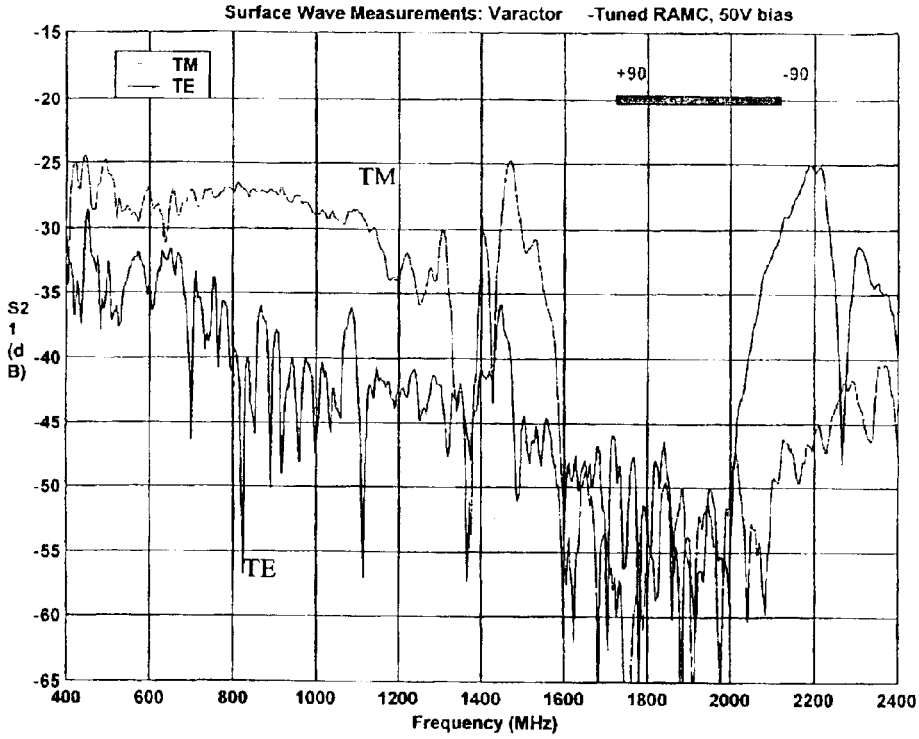
FIG. 8 is a plot of measured TE and TM mode surface wave transmission for a physical embodiment of the reconfigurable artificial magnetic conductor of FIG. 6 with a bias voltage of 50 V.
Figure 9:
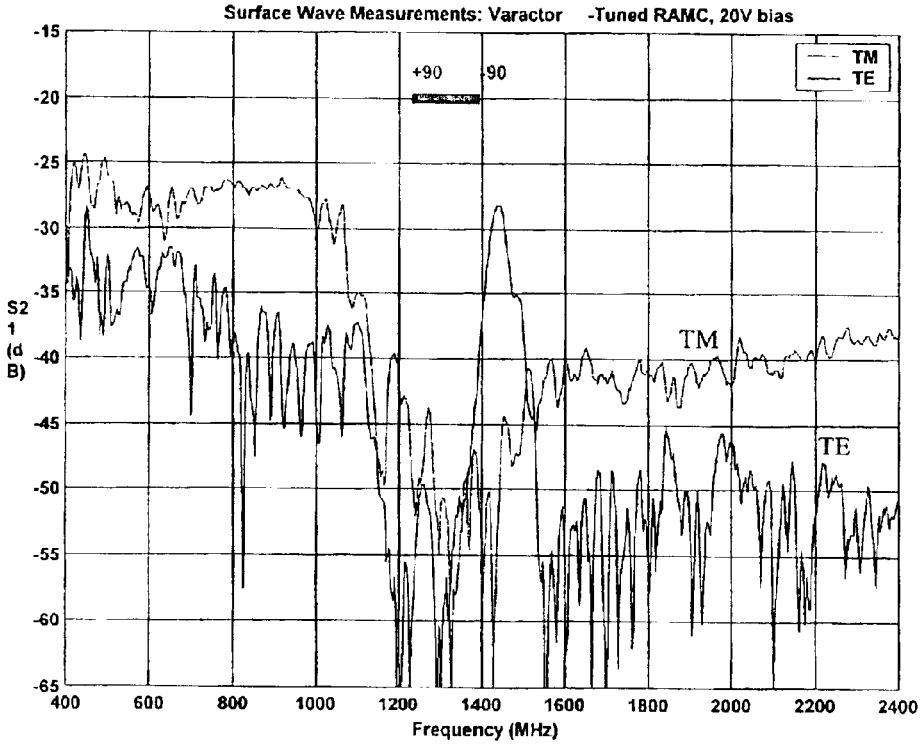
FIG. 9 is a plot of measured TE and TM mode surface wave transmission for a physical embodiment of the reconfigurable artificial magnetic conductor of FIG. 6 with a bias voltage of 20 V.

FIGS. 8, 9 and 10 show the measured $S_{21}$ for the transverse electric (TE) and transverse magnetic (TM) surface wave coupling for 50, 20 and 0 volt bias levels, respectively. The range of frequencies satisfying the +/−90 degree reflection phase criterion is indicated on each plot. The surface wave bandgaps observed are correlated closely to the +/−90-degree reflection phase bandwidths at each bias level. Broadband antennas, such as spirals, can be mounted in close proximity to the RAMC surface and exhibit good impedance and gain performance over the range of frequencies associated with the surface wave bandgap. As the RAMC is tuned over a wide range of frequencies, the spiral antenna can operate efficiently, even though the entire structure is only λo/52 thick at the lowest frequency.

FIG. 11 and FIG. 12 illustrate a second embodiment of a reconfigurable artificial magnetic conductor (RAMC) 1100. FIG. 11 is a top view of the RAMC 1100. FIG. 12 is a cross sectional view taken along line A—A in FIG. 11.

The RAMC 1100 includes a frequency selective surface (FSS) 1102, a spacer layer 1104 and a radio frequency (RF) backplane 1106. An antenna element 1103 is placed adjacent to the RAMC 1100 to form an antenna system. The backplane 1106 includes one or more bias voltage lines 1120 and a ground plane 1122. In one embodiment, the backplane is fabricated using printed circuit board technology to route the bias voltage lines. The spacer layer is pierced by conductive vias 1108. The conductive vias 1108 electrically couple bias control signals, communicated on the bias voltage lines 1120 of the conductive backplane, with adjacent conductive patches 1110 of the FSS 1102. The bias signals are labeled $V_{c1}$ and $V_{c2}$ in FIGS. 11 and 12. The bias control signals may be DC or AC signals or a combination of these. In general, the bias signals are generated elsewhere in the circuit including the RAMC 1100. In other embodiments, more or fewer bias signals may be used. The magnitude of the bias signals may be chosen depending on the electronic components and materials used in the RAMC 1100. The backplane 1106 further includes RF bypass capacitors 1116 between respective bias voltage lines 1120 and the ground plane 1122.

The FSS 1102 includes a periodic array of conductive patches 1110. In the embodiment of FIGS. 11 and 12, the FSS 1102 is a two-layer FSS. The FSS 1102 includes a dielectric layer 1130, a first layer 1132 of conductive patches disposed on a first side of the dielectric layer 1130 and a second layer 1134 of conductive patches disposed on a second side of the dielectric layer 1130. Portions of the second layer 1134 of conductive patches overlap portions of the first layer 1132 of conductive patches. The FSS 1102 further includes diode switches between selected patches of the first layer 1132 of conductive patches.

Access holes 1138 are formed in the patches of the inside or second layer 1134 and the dielectric layer 1130 so that the vias 1108 may electrically contact adjacent patches of the outside or first layer 1132. As indicated, the patches of the first layer 1132 are alternately biased to ground or a bias voltage such as $V_{c1}$ $V_2$. In this manner, the capacitance of the FSS 1102 is variable to control resonant frequency of the FSS 1102.

The FSS 1102 further includes PIN diodes 1140. A PIN diode is a semiconductor device having a p-n junction with a doping profile tailored so that an intrinsic layer is sandwiched between a p-doped layer and an n-doped layer. The intrinsic layer has little or no doping. PIN diodes are known to be used in microwave applications as RF switches. They provide a series resistance and series capacitance, which is variable with applied voltage, and they have high power-handling capacity. Thus, the PIN diodes are solid state RF switches. Other suitable types of RF switches may be substituted for the PIN diodes 1140, such as MEMS switches or MESFET switches, or even MEMS switched capacitors.

Thus, this embodiment of the RAMC 1100 is realized by using PIN diode switches in a two-layer FSS. FIGS. 11 and 12 show the general layout and the biasing scheme. The basic concept is to reconfigure the effective sheet capacitance of the FSS 1102 by using PIN diode switches 1140 to change the density of overlapping printed patches 1110 on the layers 1132, 1134. The vias 1108, indigenous to the high-impedance surface, are used to route bias currents and voltages from stripline control lines 1120 buried inside the RF backplane 1106. Thus, the AMC 1100 has a first set 1132 of conductive patches on one side of an FSS dielectric layer 1130 and a second set 1134 of conductive patches on a second side of the FSS dielectric layer 1130.

The RAMC 1100 may be described as repeated instances of a unit cell 1142. There are four diodes per unit cell. The unit cell includes, in a first plane, a pattern of three or more conductive patches 1110 disposed on a first side of the dielectric layer 1130. Each conductive patch is electrically coupled with an associated conductive via 1108. Also in the first plane, the unit cell includes RF switches, such as the PIN diodes 1140, between selected laterally adjacent conductive patches 1110, each conductive patch overlapping at least in part a spaced conductive patch 1134 on a second side of the dielectric layer 1130. The unit cell 1142 further includes, in a second plane, a conductive backplane 1106 segment extending in a plane substantially parallel to a plane including the three or more conductive patches 1110, with the associated conductive vias extending from the each conductive patch to a bias signal line of the conductive backplane.

Other geometrical configurations of the patches 1110 on the two sides of the dielectric layer 1130 may be selected in order to vary the resonant frequency of the RAMC 1100. In an alternate embodiment, the patches 1100 of a given unit cell 1142 may not be exactly four in number, and they may have a variety of dimensions. For instance, there may be 6 patches in a given unit cell, all of unique dimensions and surface area. The dissimilar surface area is advantageous when the design goal is to offer both fine and coarse tuning choices. An example is illustrated below in FIG. 13.

Consider a large array comprised of the RAMC 1100 as described in FIGS. 11 and 12. The density of "on" cells defines tuning states for a wide range of effective capacitance as seen by x or y-polarized E fields. For instance, the lowest effective FSS capacitance is realized when all PIN diodes are turned off (reverse biased). This results in the highest RAMC resonant frequency, and is referred to as a discrete tuning state of the RAMC. The highest effective FSS capacitance is realized when all of the PIN diodes are turned on (forward biased). This results in the lowest RAMC resonant frequency. Another tuning state, yielding an intermediate resonant frequency, is achieved when only half of the diodes are turned on. Such is the case when all diodes of a given unit cell are either on or off, but the unit cells which are turned on map into a checkerboard pattern across the face of the RAMC. More than two distinct control lines 1120 may be required in the RF backplane 1106, depending on the number of desired tuning states, and the amount of forward bias current that each line is designed to source.

Figure 13:
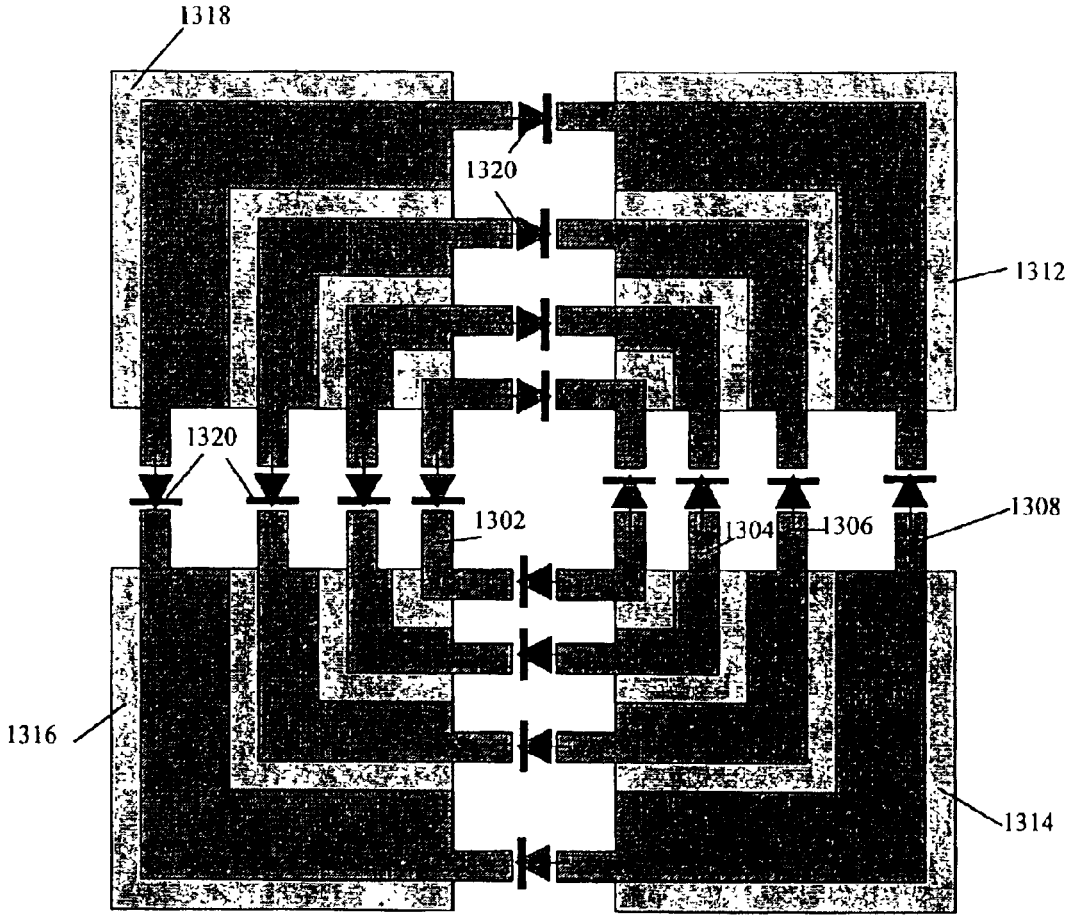
FIG. 13 is a top view of a single unit cell in another embodiment of a frequency selective surface for use in a reconfigurable artificial magnetic conductor.

FIG. 13 is a top view of an alternative embodiment of a unit cell of a frequency selective surface 1300 for use in a reconfigurable artificial magnetic conductor. The FSS 1300 provides an alternate realization of the approach to the RAMC design shown in FIGS. 11 and 12. In the embodiment of FIG. 13, the FSS 1300 includes conductive concentric square loops 1302, 1304, 1306, 1308 arranged on a first side of a dielectric layer and conductive square patches 1312, 1314, 1316, 1318 arranged on the second side of the dielectric layer. Each of the concentric loops includes a segment, which at least overlaps one of the patches 1312, 1314, 1316, 1318 and non-overlapping end segments. Non-overlapping segments are coupled at their ends by PIN diodes 1320 or other suitable RF switches. Bias voltages are applied to portions of the respective loops 1302, 1304, 1306, 1308 so as to bias individual PIN diodes into their on or off state. Other geometries may be substituted, for example, using triangular, rectangular, circular or hexagonal loops in place of the square loops 1302, 1304, 1306, 1308.

The embodiment of FIG. 13 achieves sixteen discrete tuning states using four DC control voltages by using a set of overlapping concentric square loops. This assumes that every unit cell receives the same pattern of control signals. Preliminary analysis with a full-wave simulation tool indicates that it may be possible to achieve a tunable bandwidth of greater than 10:1 using embodiments similar to that of FIG. 13.

Figure 14:
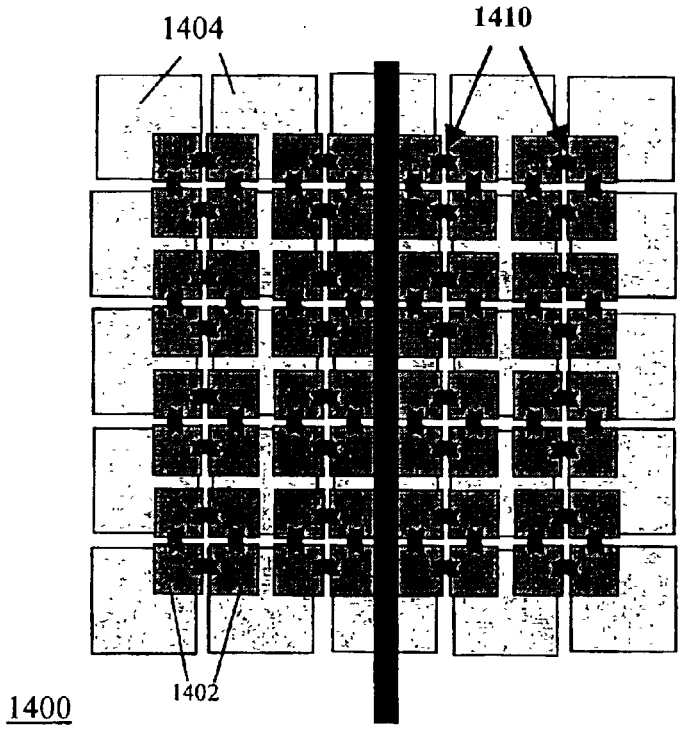
FIG. 14 is a top view of an embodiment of a reconfigurable antenna which includes a reconfigurable artificial magnetic conductor.
Figure 15:
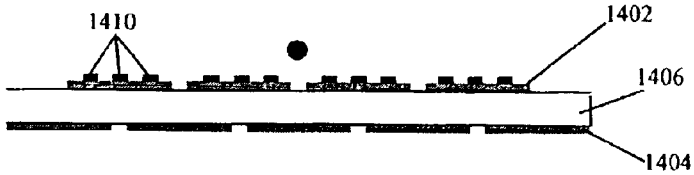
FIG. 15 is a side view of the reconfigurable antenna of FIG. 14.

FIG. 14 is a top view of another embodiment of a frequency selective surface 1400 for use in a reconfigurable artificial magnetic conductor (RAMC). FIG. 15 is a side view of the FSS 1400 of FIG. 14. In the embodiment of FIG. 14, a first periodic array of conductive patches 1402 is disposed on a first side of a dielectric layer 1406. A second periodic array of conductive patches 1404 is disposed on the second side of the dielectric layer 1406. Patches 1402 of the first array on the first side of the dielectric layer 1410 overlap patches 1404 of the second array on the second side. The geometries and relative dimensions shown in FIGS. 14 and 15 are exemplary only and may be varied to provide particular operational characteristics.

The FSS 1400 further includes micro-electromechanical systems (MEMS) switches 1410 disposed between adjacent patches 1402 of the first array. MEMS switches are electromechanical devices, which can provide a high ratio of ON to OFF state capacitance between terminals of the device. So the capacitive reactance between RF terminals can be controlled or adjusted over a very large ratio. Another broad class of MEMS switch is a type that provides an ohmic contact, which is either open (OFF) or closed (ON). An ohmic contact MEMS switch most closely emulates the function of a PIN diode since the series resistance between RF terminals is switched between low (typically $<1\Omega$) and high (typically $>10\ M\Omega$) values. MEMS switches are known for use in switching applications, including in RF communications systems. RF MEMS switches have electrical performance advantages due to their low parasitic capacitance and inductances, and absence of nonlinear junctions. This results in improved insertion loss, isolation, high linearity and broad bandwidth performance. Published MEMS RF switch designs use cantilever switch, membrane switch and tunable capacitor structures. The capacitance ratio of a capacitive type MEMS switch is variable in response to a control voltage, typically 25:1 minimum. As in the embodiments of FIG. 4 and FIG. 11, the control voltages for the MEMS switches may be routed through the vias that are intrinsic to the spacer layer of the RAMC including the FSS 1400 (not shown in FIG. 14).

Figure 19:
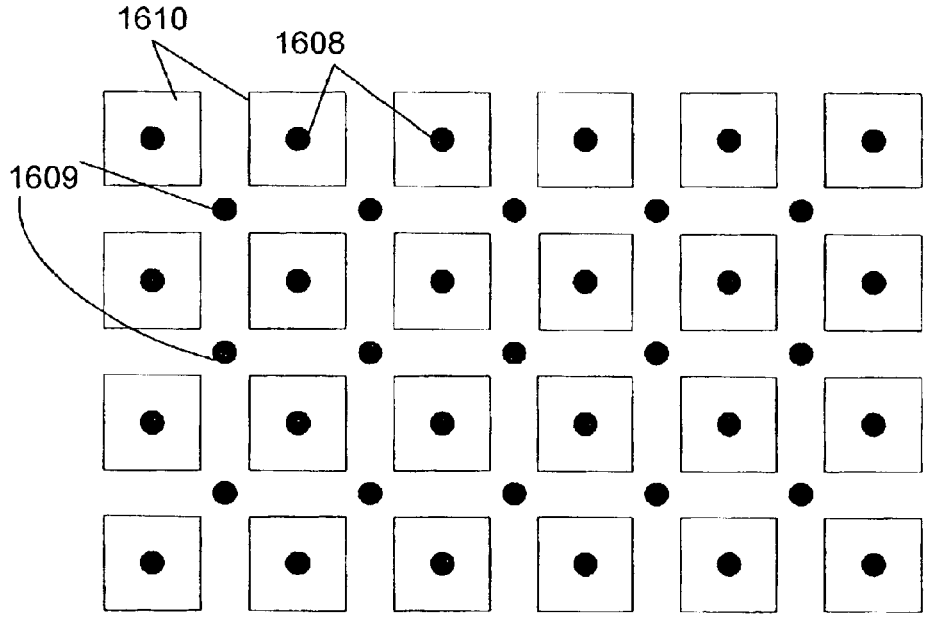
FIG. 19 is a top view of the prior art artificial magnetic conductor of FIG. 16.

FIG. 16 is a cross sectional view of a prior art artificial magnetic conductor (AMC) 1600. FIG. 19 is a top view of the AMC 1600. The AMC 1600 includes a frequency selective surface (FSS) 1602, a spacer layer 1604, and a ground plane 1606. The FSS 1602 includes a first pattern of first patches 1610 on a first side of a dielectric layer 1614 and a second pattern of second patches 1612 on a second side of the dielectric layer 1614. The spacer layer 1604 is pierced by a forest of vias including vias 1608 associated with first patches 1610 and vias 1609 associated with second patches 1612. Each via 1608, 1609 has a one-to-one association with a first patch 1610 and a second patch 1612, respectively, of the FSS 1602. That is, each patch 1610, 1612 has associated with it one and only one via 1608, 1609, and each via 1608, 1609 is associated with one and only one patch 1610, 1612.

Figure 20:
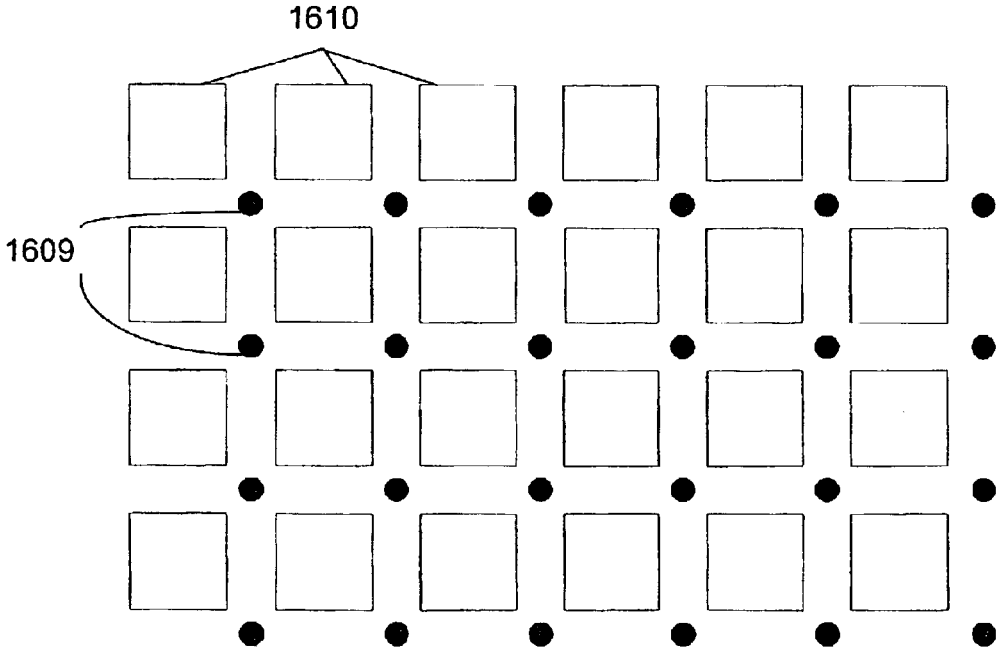
FIG. 20 is a top view of the first embodiment of the artificial magnetic conductor of FIG. 17.

FIG. 17 is a cross sectional view of a first embodiment of an artificial magnetic conductor (AMC) 1600 with a reduced number of vias 1608 in the spacer layer 1604. FIG. 20 is a top view of this same embodiment. In the embodiment of FIGS. 17 and 20, vias 1609 connect only to the lower or second patches 1612. The vias 1608 which in the embodiment of FIG. 16 had been associated with the upper or first patches 1610 are omitted. The vias 1609 are associated only with the second patches 1612. The vias 1609 may be electrically coupled with their associated patches or they may be separated from the patches 1612 by a dielectric. This can be achieved, for example, if the patches 1612 are annular with the via passing through the central region. Thus, in FIG. 17, the spacer layer of the AMC 1600 has conductive vias associated with some or all of only the first set of conductive patches formed on one side of the dielectric layer of the FSS.

Also, in FIG. 17, the vias 1609 are shown extending above the plane of the patches 1612 to the plane of the patches 1610. Alternatively, the vias 1609 may be truncated at any suitable level in the cross section of the AMC 1600.

Figure 21:
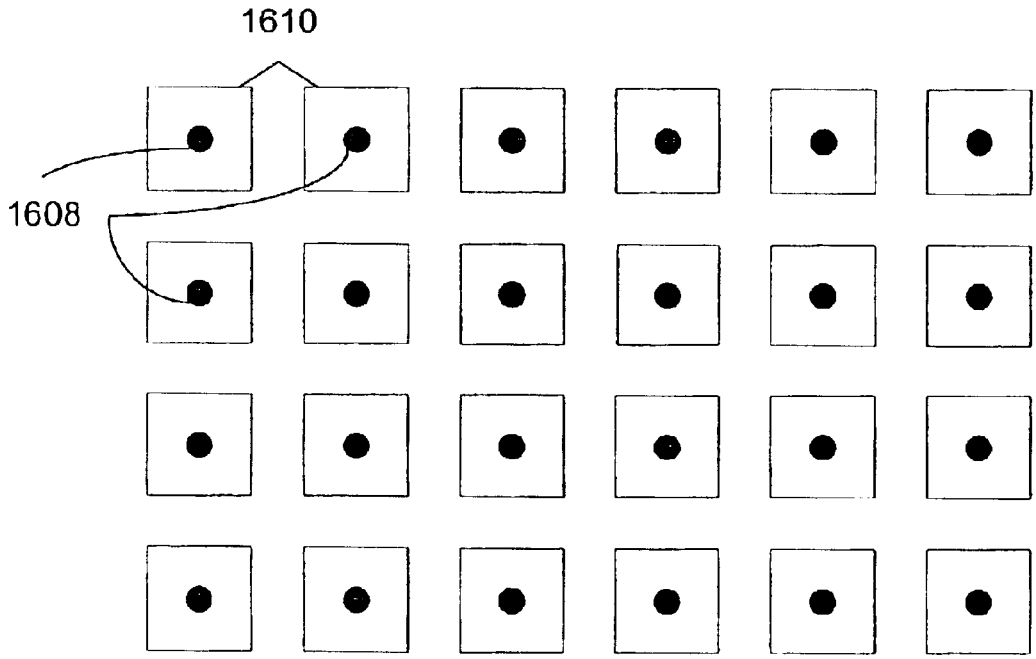
FIG. 21 is a top view of the second embodiment of the artificial magnetic conductor of FIG. 18.

FIG. 18 is a cross sectional view of a second embodiment of an artificial magnetic conductor (AMC) 1600 with a reduced number of vias in the spacer layer 1604. FIG. 21 shows a top view of this same embodiment. In the embodiment of FIGS. 18 and 21, the vias 1608 are associated only with patches 1610 of the first or upper layer of patches. Patches 1612 of the second or lower layer of patches do not have vias 1608 associated with them. As in FIGS. 17 and 20, the vias 1608 may or may not electrically connect with the patches 1610 and the length of the vias 1608 may be selected according to performance and manufacturing requirements. Thus, in FIG. 18, the spacer layer 1604 of the AMC 1600 has conductive vias associated with some or all of only the second set of conductive patches formed on one side of the dielectric layer of the FSS. Further, in the embodiments both FIGS. 17, 20 and FIGS. 18, 21, the ground plane 1606 illustrated in the figures may be replaced with an RF backplane of the type described above and including one or more ground planes and one or more striplines or other circuits or devices.

Figure 22:
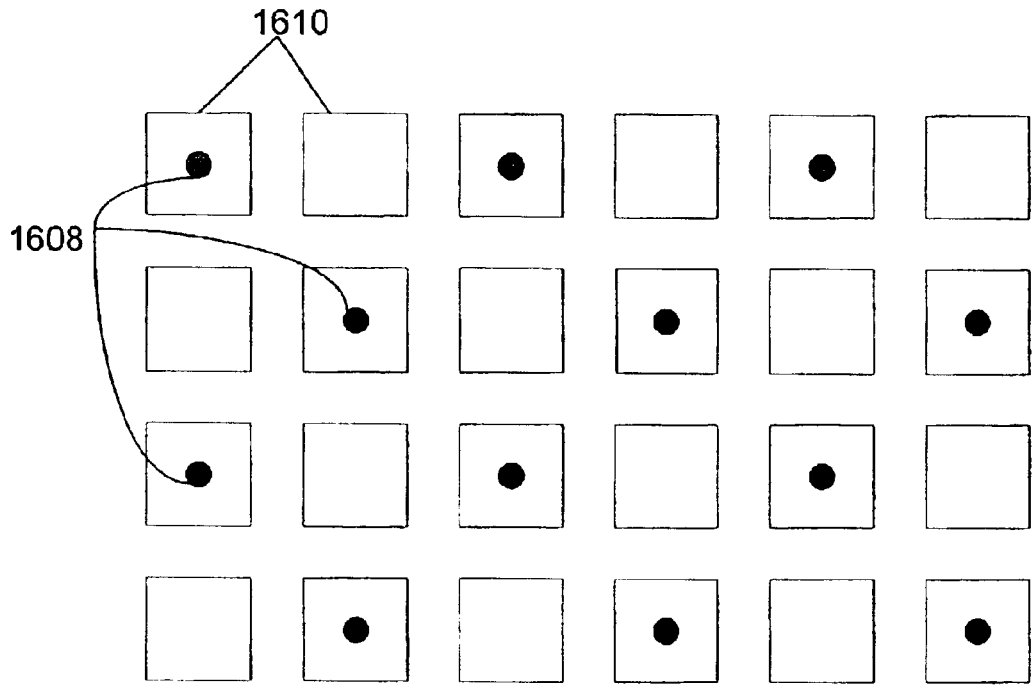
FIG. 22 is a top view of an alternative embodiment of the artificial magnetic conductor of FIG. 18.
Figure 23:
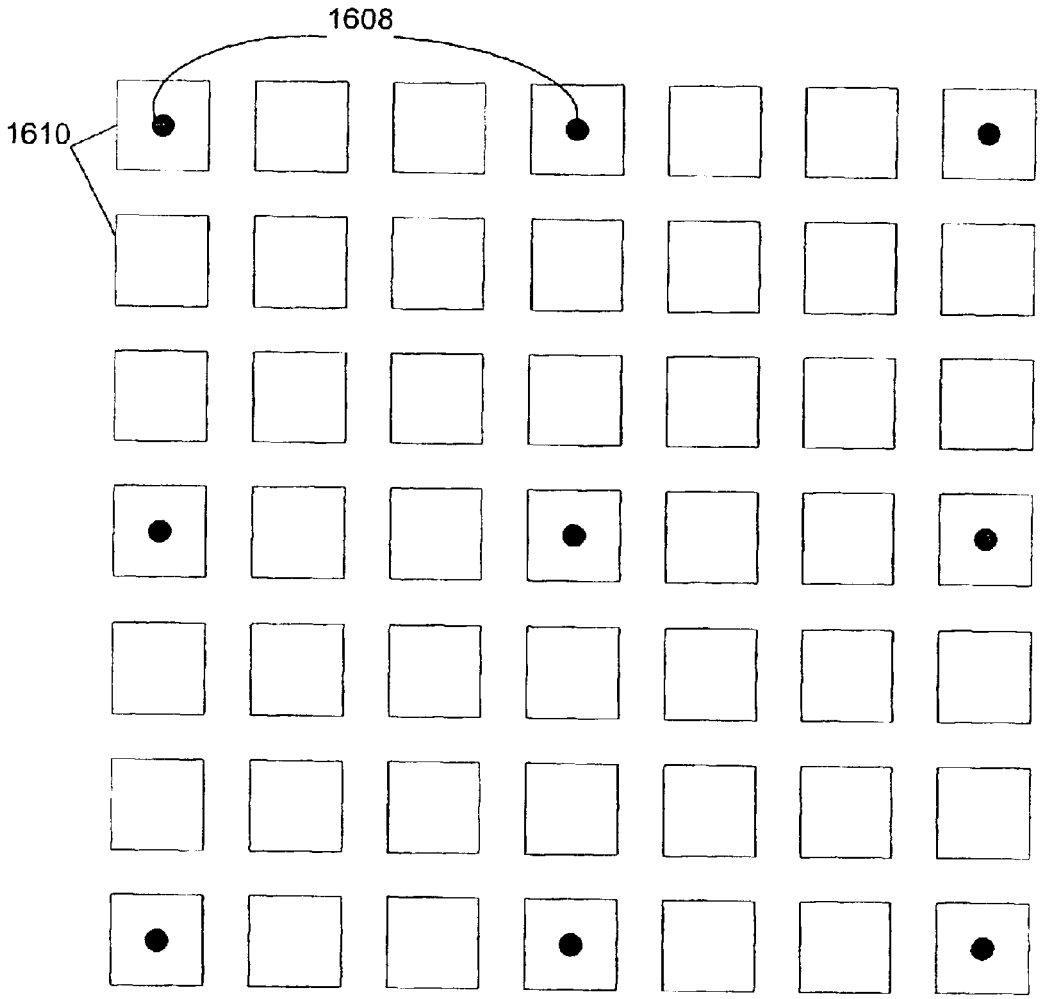
FIG. 23 is a top view of another alternative embodiment of the artificial magnetic conductor of FIG. 18.

FIG. 22 and FIG. 23 show an alternative embodiment of an AMC featuring a partial forest of vias 1608. In the embodiment of FIG. 21, one-half the total number of vias was provided in the spacer layer by omitting vias associated with the second layer of patches 1612. In the embodiment of FIG. 22, one in every four vias is installed by including only some vias associated with the first layer of patches 1610 (omitting all vias associated with the second layer of patches 1612). In FIG. 22, the installed vias 1608 form a checkerboard pattern, with a via present for every other patch 1610 along the rows and columns of patches. Similarly, FIG. 23 shows one of every eighteen vias installed, relative to a fully populated forest of vias as shown in FIG. 19. Other configurations such as non-checkerboard patterns could be used as well. For example, the patterns could be non-uniform along rows or columns of patches 1610 or in varying regions of the AMC 1600. A pattern of vias associated with one or both layers of patches 1610, 1612 may be chosen to achieve particular performance goals, such as a TM mode cutoff frequency, for the AMC or associated equipment.

Thus, the present embodiments provide an artificial magnetic conductor (AMC) which includes a partial forest of vias in the spacer layer. By partial forest, it is meant that some of the possible vias of the AMC are omitted. The omitted vias may be those related to patches on a particular layer or to patches in a particular region of the plane of the spacer layer. The resulting partial forest of vias may be uniform across the structure of the AMC or may be non-uniform.

The AMC of the embodiments illustrated herein includes a frequency selective surface (FSS) having a pattern of conductive patches, a conductive backplane structure, and a spacer layer separating the FSS and the conductive backplane structure. The spacer layer includes conductive vias associated with some but not all patches of the pattern of conductive patches. While the illustrated embodiments show omission of vias associated with patches on a single layer, other patterns of via omission may be implemented as well, including omitting vias from a region of the AMC when viewed from above.

Other embodiments may be substituted as well, as indicated above. In one embodiment, the backplane includes one or more ground planes and conductive vias are in electrical contact with the ground plane. In another embodiment, the backplane includes bias signal lines, which are in electrical contact with a subset or all of the vias. By selective application of bias signals, the effective sheet capacitance of the AMC may be varied to tune the AMC. In still another embodiment, the backplane includes both a ground plane or ground planes and bias signal lines.

In still another embodiment, the AMC includes a single layer of conductive patches on one side of a dielectric layer. In the simplest embodiment, a subset of the patches have associated with them vias in the spacer layer shorted to a ground plane. For example, alternate patches may have vias omitted from the forest of vias creating a partial forest of vias in a checkerboard pattern. Other patterns may be chosen as well to tailor the performance of the AMC. In other embodiments, the dielectric layer is tunable so that the AMC is resonant at more than one selectable frequency or bands of frequencies. In such an embodiment, some or all of the vias may be electrically biased to control the tuning of the AMC. Biasing signals may be applied from the backplane or generally from behind the AMC, or biasing signals may be applied from in front of the AMC such as through a biasing network of resistors or other components. In yet another embodiment, the AMC includes first and second layers of conductive patches on opposing sides of a dielectric film.

A reconfigurable AMC (RAMC) realized by integrating varactor diodes into a single layer FSS is illustrated in FIGS. 4 and 5. This figure shows the general layout and the biasing scheme. The basic idea is that the varactor diodes add a voltage-variable capacitance in parallel to the intrinsic capacitance of the FSS layer. In this embodiment, the bias voltage is applied through the RF backplane. The vias, indigenous to the high-impedance surface, are used to route DC bias currents and voltages from stripline control lines buried inside the RF backplane. RF bypass capacitors are used to decouple RF current at the base of the biasing vias. A ballast resistor of large value is placed in parallel with each diode to ensure an equal voltage drop across each series diode in the strings that are found between the biasing vias and the grounded vias. In practice, varactor diodes can be installed in a "thinned" pattern as shown in FIGS. 4 and 6 so as to reduce the number of varactors per unit area, and hence the cost, weight, and complexity. In the example shown, every other row and column is "thinned" for the integration of diodes. However, we could also skip two, three, or N rows of patches between diode strings (so long as the spacing of diodes remains smaller than approximately one quarter of a free space wavelength).

Figure 24:
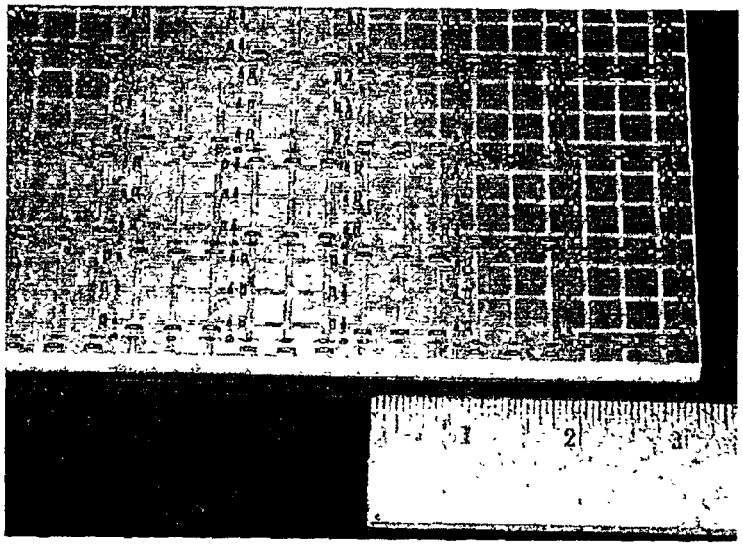
FIG. 24 is a photograph of a varactor-tuned reconfigurable artificial magnetic conductor.

A physical realization of this approach, where every third unit cell contains a varactor is shown in FIG. 24. This model was fabricated by sandwiching a 250 mil thick foam core ($\epsilon_r$=1.07) between two printed circuit boards. The upper board is single-sided 60 mil Rogers R04003 board and forms the FSS. Plated through holes are located in the center of one out of every nine square patches, 300 mils on a side with a period of 360 mils. Tuning diodes are M/A-COM GaAs MA46H202 diodes, and the ballast resistors are each 2.2 MΩ chips. The RAMC is assembled by installing 22 AWG wire vias between the FSS board and the RF backplane on 1080 mil centers. The RF backplane is a 3 layer FR4 board, 62 mils thick, which contains an internal stripline bias network. Ceramic decoupling capacitors are used on the bottom side of the RF backplane, one at every biasing via (providing an RF short while maintaining DC isolation from ground). The size of the RAMC substrate is 10"×16"

Figure 25:
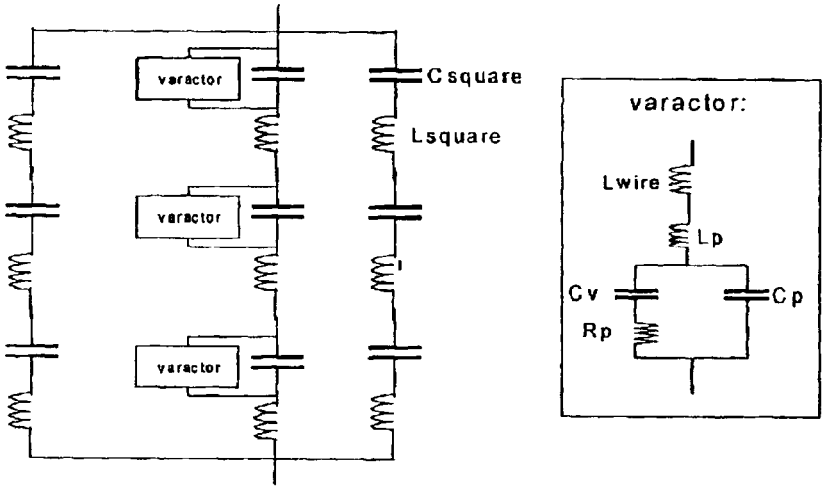
FIG. 25 is a circuit diagram of an equivalent circuit model for the in-plane admittance of the frequency selective surface portion of the reconfigurable artificial magnetic conductor of FIG. 24.

The design was accomplished initially using a simple equivalent circuit model analysis followed by rigorous analysis using a commercial TLM simulator and rigorous surface wave analysis. The equivalent circuit model for the FSS shown in FIG. 25 included the extended unit cell (with diodes on every third patch) as well as practical implementation effects including diode packaging capacitance and necking inductance at the leads of each diode).

The measured reflection coefficient phase angle versus frequency is shown in FIG. 7 with the varactor bias voltage as a parameter. At each bias level, the instantaneous +/−90-degree bandwidth of the device is relatively narrow , but it can be continuously tuned across a much wider frequency band from 590 to 2110 MHz (0° reflection phase tunes from approximately 590 to 1920 MHz)

A test set-up is used to experimentally verify the existence of a TE surface wave bandgap. In this case, the transmission response ($S_{21}$) is measured between two Vivaldi-notch radiators that are mounted so as to excite the dominant electric field polarization for TE modes on the AMC surface. For the TE set-up, both antennas are oriented horizontally. For the TM set-up , the antennas are oriented vertically. Absorber is placed around the surface-under-test to minimize the space wave coupling between the antennas. The optimal configuration—defined empirically as "that which gives us the smoothest, least-noisy response and cleanest surface wave cutoff"—is obtained by trial and error. This optimal configuration is obtained by varying the location of the antennas, the placement of the absorber, the height of absorber above the surface-under-test, the thickness of absorber, and by placing a conducting foil "wall" between layers of absorber.

Figure 26:
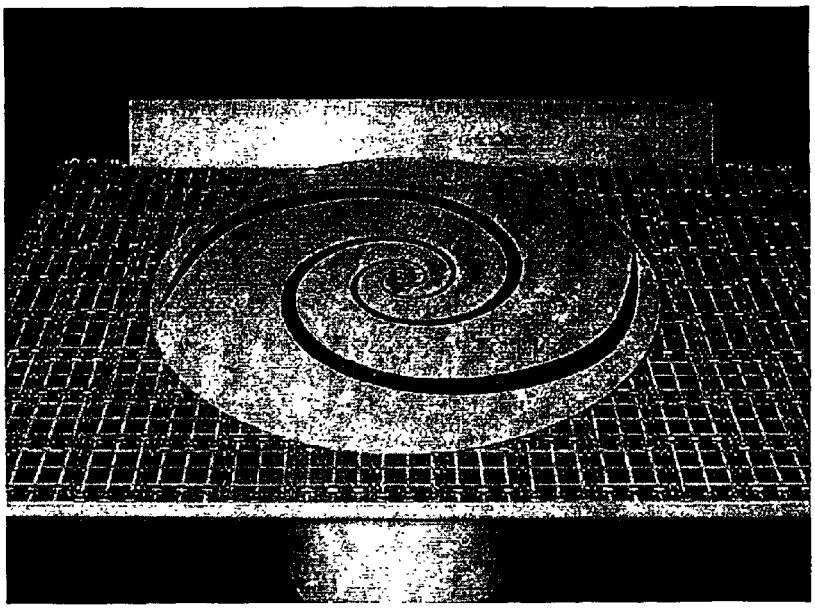
FIG. 26 is a photograph of a spiral antenna located above the varactor-tuned reconfigurable artificial magnetic conductor of FIG. 24.

Demonstration of the properties in the previous section is necessary in order to characterize the AMC surface. However, in order for the AMC to be of practical use, we now consider integrated wire antenna/AMC radiating structures consisting of flush-mounted wire elements in close proximity to the AMC. Similar to the choice for the AMC itself, we can choose an antenna element with broad instantaneous bandwidth or a narrowband element which is tuned. In this case, the tradeoff in complexity associated with tuning is not favorable because broadband elements can be realized without severe penalties in size/weight. FIG. 26 shows an 8 inch diameter, non-complementary, equiangular spiral flush mounted above the reconfigurable AMC. Note that the equiangular spiral arms contain less metal than a complementary spiral structure. This was done to minimize the capacitive perturbation to the AMC FSS layer. The spiral was etched on a 60 mil substrate of Rogers R04003. On the lower side of the substrate was attached a 100 mil thick foam spacer layer. This foam rested against the surface mounted diodes and chip resistors installed on the RAMC, such that the printed spiral was about 0.150" above the printed FSS surface. This spiral was fed with a Chebyshev-Duncan coaxial balun, which exhibited approximately a 3:1 impedance transformation ratio (50:150Ω). When the spiral is in a free space environment, the return loss looking into the balun-fed spiral with a 50 ohm system is less than −8 dB over 400 MHz to 1000 MHz, less than −10 dB over 1000 MHz to 1200 MHz, and less than −15 dB over 1200 MHz to 2 GHz.

Figure 27:
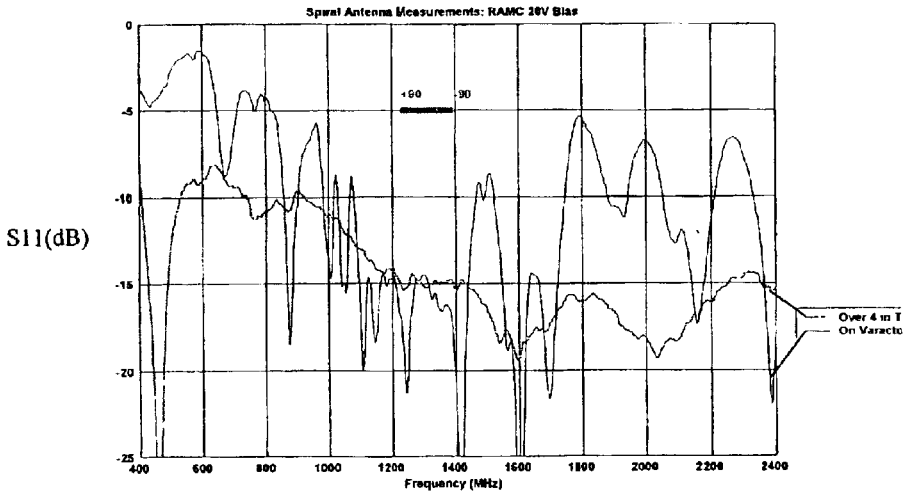
FIG. 27 illustrates return loss measurement data for the reconfigurable artificial magnetic conductor-backed spiral antenna of FIG. 26 with bias set at 20 volts.
Figure 28:
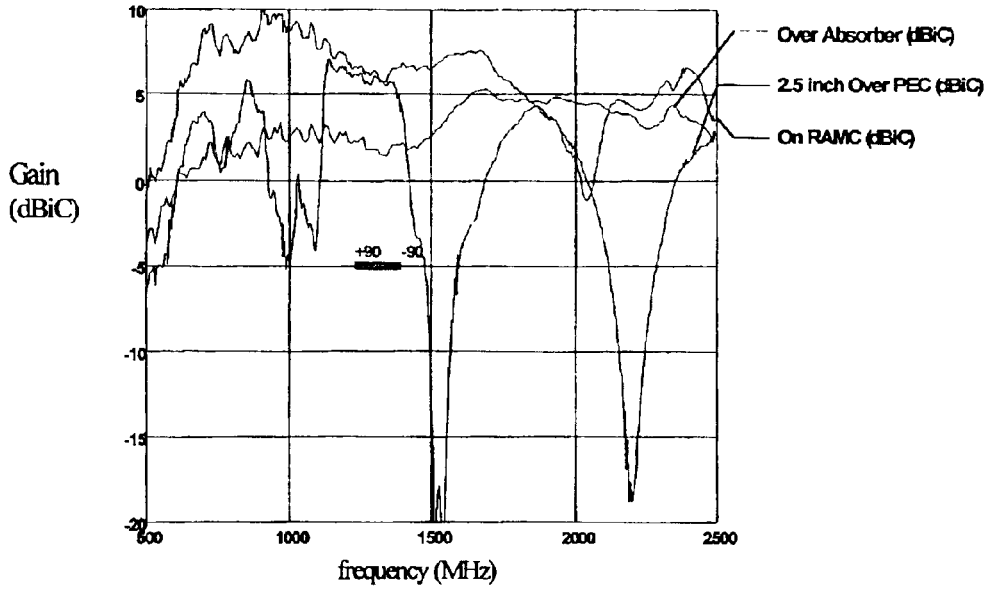
FIG. 28 illustrates swept boresight gain for the reconfigurable artificial magnetic conductor-backed spiral antenna of FIG. 26 with bias set at 20 volts.

FIGS. 27 and 28 illustrate the fact that the broadband printed spiral antenna has a high gain bandwidth and a good impedance match over a range of frequencies defined explicitly by the surface wave bandgap of the RAMC upon which it rests. For the case of a 20 volt bias, the return loss has a plateau at approximately −15 dB over the frequency range of 1100 to 1400 MHz, which is effectively the surface wave bandgap. Also, the swept gain plot of FIG. 28 reveals that the broadside gain of the RAMC backed spiral is at least 3 dB higher than the case of the same spiral located above an absorber (i.e. in free space), for a frequency range from about 1150 to 1350 MHz, which is within the frequency range of the surface wave bandgap.

Figure 29:
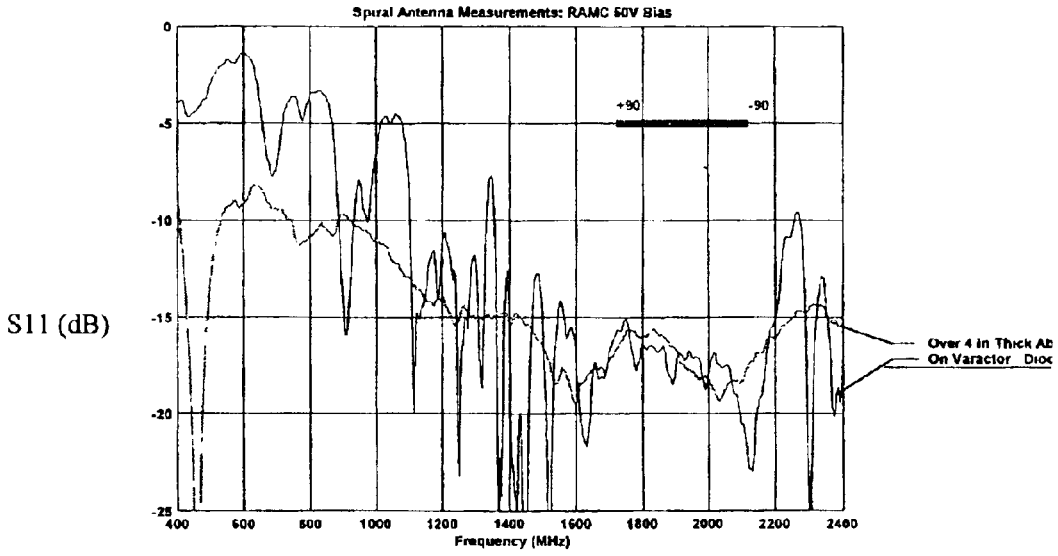
FIG. 29 illustrates return loss measurement data for the reconfigurable artificial magnetic conductor-backed spiral antenna of FIG. 26 with bias set at 50 volts.
Figure 30:
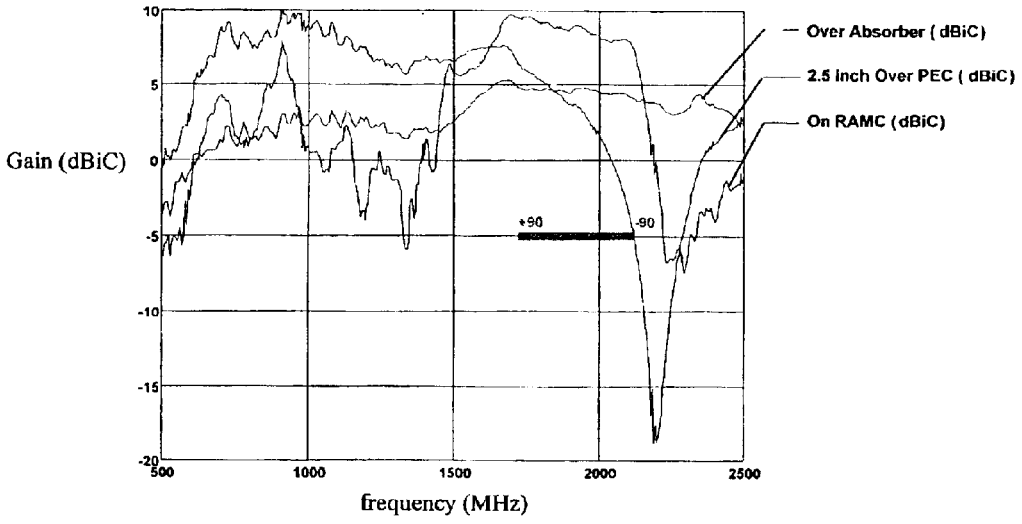
FIG. 30 illustrates swept boresight gain for the reconfigurable artificial magnetic conductor-backed spiral antenna of FIG. 26 with bias set at 50 volts.

When the RAMC is biased to 50 volts, the surface wave bandgap extends from approximately 1600 to 2100 MHz. FIG. 29 reveals that the return loss of the spiral element on this RAMC drops below −15 dB over this same frequency range. The swept gain shown in FIG. 30 reveals that the boresight gain is at least 3 dB higher than the case of the same spiral located above an absorber, for the same frequency range of 1600 MHz to 2100 MHz.

Thus, by electronically adjusting the surface wave bandgap of the RAMC, we can obtain the desirable properties of an integrated planar broadband element over a wide tuning range. Just as the AMC reflection phase and surface wave bandgap are tuned smoothly by analog changes to the bias voltage, the antenna match and gain characteristics tuned smoothly across more than 3:1 bandwidth. This broadband behavior of a frequency independent element on a RAMC is possible using other classic broadband elements such as a bowtie antenna, a log-periodic bowtie, other planar log-periodic structures, etc.

For comparison, consider the commercially available Spiral Antenna Model 2090 from Microwave Engineering Corporation. This antenna is a spiral over an absorber-filled cavity with 9" diameter and 3.5" depth. The published gain characteristic (available on their web site) is very similar to the spiral presented here when placed over an absorber. In essence the RAMC approach allows us to achieve at least 3 dB more gain in a much thinner structure at a cost of decreased instantaneous bandwidth and added complexity.

From the foregoing, it can be seen that the present invention provides a broadband spiral antenna mounted over a reconfigurable artificial magnetic conductor (AMC) which exhibits good impedance and gain performance over the range of frequencies defined by the high impedance band and surface wave bandgap of the AMC. As the RAMC is tuned over a wide range of frequencies, the spiral antenna can operate efficiently in the surface wave bandgap, even though the entire structure is only $\lambda o/30$ thick at the lowest frequency.

These embodiments illustrate several key concepts. First, a very physically and electrically thin antenna can be fabricated by installing a broadband printed element very close to a RAMC surface. In this case, the RAMC plus spiral has a total height of $\lambda/20$ at 1 GHz. Second, over the frequency range defined by the tunable surface wave bandgap, the gain of this spiral at boresight, or broadside, is at least 3 dB greater than for the case of the same spiral element backed by an absorber. (3) The impedance match for the antenna is good (−15 dB or better) only over the high-impedance band for the AMC.

While a particular embodiment of the present invention has been shown and described, modifications may be made. For example, while the embodiments described herein have been shown implemented using printed circuit board technology, the concepts described herein may be extended to integration in a single semiconductor device such as an integrated circuit or wafer of processed semiconductor material. This is especially attractive for the integration of MEMS switches. Such an embodiment may provide advantages of increased integration, and reduced size or reduced weight, or reduced cost. It is therefore intended in the appended claims to cover such changes and modifications which follow in the true spirit and scope of the invention.

What is claimed is:

1. An antenna system comprising:

an artificial magnetic conductor (AMC) including a frequency selective surface (FSS) including voltage variable capacitive elements to give the FSS an effective sheet capacitance which is variable to control resonant frequency of the AMC; and an antenna element positioned adjacent to the FSS.

2. The antenna system of claim 1 wherein the antenna element comprises an antenna having instantaneous bandwidth of one octave or greater in free space.

3. The antenna system of claim 1 wherein the antenna element comprises:

a tuned narrowband antenna.

4. The antenna system of claim 1 wherein the antenna element comprises a bent wire monopole antenna.

5. The antenna system of claim 1 wherein the antenna element comprises a spiral antenna flush mounted with the FSS.

6. The antenna system of claim 1 wherein the antenna element comprises a bowtie antenna.

7. The antenna system of claim 6 wherein the antenna element comprises a log-periodic bowtie antenna.

8. The antenna system of claim 1 wherein the FSS comprises:

one or more layers of capacitively coupled conductive patches.

9. The antenna system of claim 8 further comprising:

one or more variable capacitance elements integrated into the FSS.

10. An antenna system comprising:

an artificial magnetic conductor (AMC) including a frequency selective surface (FSS), a conductive backplane structure, a spacer layer separating the conductive backplane structure and the FSS, the spacer layer including conductive vias extending between the conductive backplane structure and the FSS, and voltage variable capacitive circuit elements coupled with the FSS and responsive to one or more bias signal lines routed through the conductive backplane structure and the conductive vias; and an antenna element positioned adjacent to the AMC.

11. The antenna system of claim 10 wherein the antenna element comprises a bent wire monopole antenna.

12. The antenna system of claim 10 wherein the antenna element comprises a spiral antenna flush mounted with the FSS.

13. An antenna system comprising:

an artificial magnetic conductor (AMC) including a frequency selective surface (FSS) including a periodic array of conductive patches;

a space layer including vias extending therethrough in association with predetermined conductive patches of the FSS; and a conducting backplane structure including two or more bias signal lines, the AM characterized by a unit cell including in a first lane, a pattern of three or more conductive patches, one conductive patch electrically coupled with an associated conductive via, and voltage variable capacitive elements between select laterally adjacent conductive patches; and a conductive backplane segment extending in a second plane substantially parallel to a plane including the three or more conductive patches and the associated conductive via extending from the one conductive patch to one of the two or more bias signal lines; and an antenna element positioned adjacent to the AMC.

14. The antenna system of claim 13 wherein the antenna element comprises a bent wire monopole antenna.

15. The antenna system of claim 13 wherein the antenna element comprises a spiral antenna flush mounted with the FSS.

16. A method for tuning an antenna system which includes an antenna element adjacent to an artificial magnetic conductor (AMC) having a frequency selective surface (FSS) which has a pattern of conductive patches, a conductive backplane structure and a spacer layer separating the FSS and the conductive backplane structure, the method comprising:

applying bias control signals to voltage variable capacitive elements associated with the FSS; and thereby, reconfiguring effective sheet capacitance of the FSS to tune the antenna.

17. The method of claim 16 wherein applying bias control signals comprises applying the bias control signals to conductors located in the conductive backplane structure and coupled to selected conductive patches by conductors extending through the spacer layer.

18. The method of claim 16 further comprising:

tuning a resonant frequency of the AMC.

19. An antenna system comprising:

an artificial magnetic conductor (AMC) comprising a frequency selective surface (FSS) having a pattern of conductive patches, a conductive backplane structure, and a spacer layer separating the FSS and the conductive backplane structure, the spacer layer including conductive vias associated with some but not all patches of the pattern of conductive patches; and an antenna positioned an effective distance from the FSS.

20. The AMC of claim 19 wherein the conductive backplane structure comprises at least one ground plane, the conductive vias being in electrical contact with the at least one ground plane.

21. The AMC of claim 19 wherein the FSS comprises:

a first set of conductive patches on one side of an FSS dielectric layer, and a second set of conductive patches on a second side of an FSS dielectric layer.

22. The AMC of claim 21 wherein the spacer layer has conductive vias associated with some or all of only the first set of conductive patches.

23. The AMC of claim 22 wherein the spacer layer has conductive vias associated with some or all of only the second set of conductive patches.

24. The AMC of claim 19 wherein the conductive backplane structure comprises bias signal lines in electrical contact with at least a subset of the conductive vias.

25. The AMC of claim 24 wherein the conductive backplane structure further comprises at least one ground plane, at least a second subset of the conductive vias being in electrical contact with the at least one ground plane.

26. The AMC of claim 19 wherein the FSS comprises:

a layer of conductive patches on one side of a dielectric layer.

27. The AMC of claim 19 wherein the FSS comprises:

a layer of conductive patches on one side of a tunable dielectric layer.

28. The AMC of claim 19 wherein the FSS comprises:

a first layer of conductive patches on one side of a tunable dielectric film; and a second layer of conductive patches on a second side of the tunable dielectric film.

29. The AMC of claim 28 wherein the spacer layer comprises:

a first set of conductive vias associated with at least some patches of the first layer of conductive patches; and a second set of conductive vias associated with at least some patches of the second layer of conductive patches.

30. An antenna system comprising:

an antenna; and a high impedance surface adjacent the antenna, the high impedance surface comprising:

a frequency selective surface (FSS) patterned with conductive patches;

a conductive ground plane; and a layer separating the FSS and the conductive backplane structure, the layer including a dielectric material pierced by a partial forest of conductive vias.

31. The antenna system of claim 30 wherein the antenna comprises a bent wire monopole antenna.

32. The antenna system of claim 30 wherein the antenna comprises a spiral antenna flush mounted with the FSS.

33. The antenna system of claim 30 wherein the antenna comprises a bowtie antenna.

* * * * *

UNITED STATES PATENT AND TRADEMARK OFFICE

CERTIFICATE OF CORRECTION

PATENT NO. : 6,917,343 B2
APPLICATION NO. : 10/246198
DATED : July 12, 2005
INVENTOR(S) : Victor C. Sanchez et al.

It is certified that error appears in the above-identified patent and that said Letters Patent is hereby corrected as shown below:

In the Claims

Column 17, in claim 13, line 10, before "characterized by" delete "AM" and substitute --AMC-- in its place.

Column 17, in claim 13, line 14, before "laterally adjacent" delete "select" and substitute --selected-- in its place.

Signed and Sealed this

Fifth Day of December, 2006

JON W. DUDAS
*Director of the United States Patent and Trademark Office*